US005508795A

United States Patent [19]

Kikuchi

[11] Patent Number: 5,508,795

[45] Date of Patent: Apr. 16, 1996

[54] DEVELOPING DEVICE AND IMAGE FORMING APPARATUS WITH THE SAME

[75] Inventor: Kazuhiko Kikuchi, Yokohama, Japan

[73] Assignees: Kabushiki Kaisha Toshiba, Kawasaki; Kabushiki Kaisha TEC, Shizuoka, both of Japan

[21] Appl. No.: 207,611

[22] Filed: Mar. 9, 1994

[30] Foreign Application Priority Data

Mar. 9, 1993 [JP] Japan ..... 5-048270

[51] Int. Cl.[6] ..... G03G 15/06

[52] U.S. Cl. ..... 355/260; 355/245

[58] Field of Search ..... 355/200, 203, 355/204, 206, 208, 210, 245, 260, 326 R; 222/DIG. 1

[56] References Cited

U.S. PATENT DOCUMENTS

| | | | |
|---|---|---|---|
| 4,987,451 | 1/1991 | Hikosaka et al. | 355/245 |
| 5,040,025 | 8/1991 | Fukuchi | 355/260 |
| 5,074,344 | 12/1991 | Vacek et al. | 222/DIG. 1 X |
| 5,077,584 | 12/1991 | Tanaka et al. | 355/260 |
| 5,089,854 | 2/1991 | Kaieda et al. | 355/260 |
| 5,101,233 | 3/1992 | Ito et al. | 355/209 |
| 5,136,333 | 8/1992 | Craft et al. | 355/200 X |
| 5,155,527 | 10/1992 | Gokita et al. | 355/204 |
| 5,229,824 | 7/1993 | Tsusaka et al. | 355/260 |
| 5,313,993 | 5/1994 | Corby et al. | 222/DIG. 1 X |

FOREIGN PATENT DOCUMENTS

| | | |
|---|---|---|
| 0262640 | 4/1988 | European Pat. Off. . |
| 4-19670 | 1/1992 | Japan . |
| 4-16865 | 1/1992 | Japan . |

*Primary Examiner*—Sandra L. Brase
*Attorney, Agent, or Firm*—Foley & Lardner

[57] ABSTRACT

A printer comprises a process unit which includes a photoconductive drum, a developing device having a toner storage section, a replaceable toner cartridge for supplying toner to the toner storage section, a cleaner for clearing the photoconductive drum of the toner remaining thereon after transfer, and a waste toner storage section for receiving the toner removed by means of the cleaner. The developing device is provided with a locking member for locking the mounted toner cartridge lest it be replaceable, a sensor for detecting a reduction of the amount of the toner in the toner storage section in the developing device below a predetermined value, and an unlocking member for unlocking the toner cartridge locked by the locking member when the reduction of the toner amount below the predetermined value is detected by the sensor.

21 Claims, 24 Drawing Sheets

| | | | | | | | | | | | | | | | |
|---|---|---|---|---|---|---|---|---|---|---|---|---|---|---|---|
| d15 | d14 | d13 | d12 | d11 | d10 | d9 | d8 | d7 | d6 | d5 | d4 | d3 | d2 | d1 | d0 |

DEVELOPING DEVICE AND IMAGE FORMING APPARATUS WITH THE SAME

BACKGROUND OF THE INVENTION

1. Field of the Invention

The present invention relates to a developing device and an image forming apparatus, such as an electrophotographic apparatus or electrostatic printer, which is provided with a developing device for visualizing an electrostatic latent image and a toner cartridge for replenishing the developing device with toner.

2. Description of the Related Art

Recently, there have been provided many image forming apparatuses which incorporate a removable process unit. In general, process units integrally comprise an image carrier, a developing device, a cleaner for clearing the image carrier of the toner remaining thereon after transfer, and a waste toner receiving section for receiving the toner removed by means of the cleaner. Among these process units, those which use a removable toner cartridge for replenishing the developing device with the toner have an advantage over those which are furnished with an integral toner cartridge in entailing lower initial cost.

Generally, moreover, life management of the process unit is based on its lifetime print quantity or frequency of toner-empty detection. If the lifetime print quantities for the process unit and each toner cartridge are 10K and 5K, respectively, the life is determined depending on the detection of the attainment of 10K by the print quantity or a second detection of a toner-empty state, whichever is earlier.

Usually, in this case, the lifetime print quantity is a value for standard printing (with print ratio of 5%, for example), so that it is inevitably subject to variation depending on the user of the apparatus. The frequency of toner-empty detection is a question here. If the user replaces the toner cartridge before the toner-empty state is established, for example, then the toner-empty state cannot be detected, so that the life of the process unit will be determined solely by the print quantity.

No problem will be aroused, in this situation, if the user employs an average print ratio lower than the standard print ratio. If the user's average print ratio is higher than the standard ratio, however, the printing entails a large toner consumption, unlimited in an extreme case.

Thus, in the process unit which contains therein the receiving section for receiving the waste toner removed by the cleaner for clearing the image carrier of the toner remaining thereon after transfer, the capacity of the waste toner receiving section must be made so large that the process unit itself is very bulky.

To cope with this, a method for detecting the frequency of toner cartridge mounting is conventionally proposed. According to this method, however, the apparatus body should be provided with a detecting section for the cartridge mounting frequency besides the toner-empty detecting means. With use of this frequency detecting section, however, the life management cannot be effected if a unicolor process unit is used in the middle of the operation. In this case, therefore, the developing device must be also furnished with a detecting mechanism for the toner cartridge mounting frequency. Inevitably, therefore, the process unit is complicated and expensive.

In order to miniaturize the process unit, the size of the toner storage section must be minimized. If the capacity of this storage section is made smaller than that of the toner cartridge, however, the toner may spill from the process unit and soil the apparatus body or its surroundings when the cartridge is replaced before the toner-empty state is detected.

As mentioned before, furthermore, the life management of the conventional process unit is based on its lifetime print quantity or frequency of toner-empty detection. In the case where the lifetime print quantity is used as the criterion, in particular, the user of the apparatus who employs a low print ratio may possibly replace the process unit whose printing capacity is not exhausted yet, thus suffering a low economical efficiency.

SUMMARY OF THE INVENTION

The present invention has been contrived in consideration of these circumstances, and its object is to provide a developing device and an image forming apparatus, in which the toner is prevented from being caused to spill by wrong toner cartridge replacement, the capacity of a toner storage section is reduced to realize miniaturization of a process unit, and life management can be achieved for effective use of the toner without regard to the user's application, thus ensuring improved practicality.

In order to achieve the above object, according to the present invention, a developing device comprises toner storage means for storing toner, means for supplying the toner to the image carrier, and a replaceable toner cartridge for supplying toner to the toner storage means. The developing device further comprises locking means for locking the mounted toner cartridge lest the cartridge be replaceable, detecting means for detecting the amount of the toner in the toner storage means, and unlocking means for unlocking the toner cartridge locked by the locking means when the amount of toner decreases below a predetermined value.

With the above arrangement, the toner cartridge is locked by the locking means when it is mounted, and its replacement is allowed only when the cartridge is released from the locking means as the amount of the toner in the toner storage means in the developing device is reduced below the predetermined value.

Further, according to the present invention, a developing device comprises locking means for locking the last one of a predetermined number of toner cartridges, which have been mounted on the toner storage means, lest the last cartridge be replaced by another.

According to an image forming apparatus of the present invention, a developing device comprises locking means for locking the toner cartridge on the toner storage means lest the toner cartridge be replaced by another, detecting means for detecting the amount of the toner in the toner storage means, unlocking means for unlocking the toner cartridge locked by the locking means only when the detecting means detects that the amount of the toner in the toner storage means decreases below a predetermined value, and restraining means for preventing the unlocking means from unlocking the toner cartridge when the last one of a predetermined number of toner cartridges is mounted.

With this arrangement, the toner cartridge is locked by the locking means when it is mounted, and is released from the locking means by the unlocking means when the amount of the toner in the toner storage means is reduced below the predetermined value. When the last one of the predetermined number of toner cartridges is mounted, it is disabled from being unlocked by the unlocking means.

Thus, the toner can be prevented from being caused to spill by wrong toner cartridge replacement, and the capacity of the toner receiving means can be reduced.

Furthermore, an image forming apparatus according to the present invention comprises a process unit removably mounted in a housing, the process unit integrally including an image carrier, a developing device including a toner storage section, a toner cartridge for replenishing the developing device with a toner, cleaning means for clearing the image carrier of the toner remaining thereon after transfer, and a waste toner receiving section for receiving the toner removed by means of the cleaning means, detecting means for detecting a reduction of the amount of the toner in the toner storage section in the developing device below a predetermined value, and control means. The control means includes first counting means for counting cycles of detection by the detecting means, second counting means for counting prints produced by the process unit, first and second memory means for storing count values in the first and second counting means, respectively, third memory means for storing the quantity of available prints, and means for issuing a warning for the replacement of the process unit. The control means actuates the warning means, resets the count value stored in the second memory means, stores the third memory means with a desired available print quantity, and controls the quantity of prints for the process unit after the display of the warning for the replacement in accordance with the available print quantity stored in the third memory means, when the count value in the second memory means is equal to the lifetime print quantity for the process unit or when the count value in the first memory means is equal to the maximum available toner cartridge number for the process unit.

According to the arrangement described above, when the amount of the toner in the toner storage section in the developing device is reduced below the predetermined value, the detecting means detects this, the cycles of the detection are counted by the first counting means, and the resulting count value is stored in the first memory means. Also, the prints produced by the process unit are counted by the second counting means, and the resulting count value is stored in the second memory means. When the count value in the second memory means is equal to the lifetime print quantity for the process unit or when the count value in the first memory means is equal to the maximum available toner cartridge number for the process unit, the warning for the replacement of the process unit is displayed on display means, the count value in the second memory means is reset, and the third memory means is stored with the desired available print quantity. Then, the print quantity for the process unit after the display of the warning for the replacement is controlled in accordance with the available print quantity stored in the third memory means. Thus, life management can be achieved for effective use of the toner without regard to the user's application.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 5 show a printer according to a first embodiment of the present invention, in which:

FIG. 1 is a sectional view of the printer,

FIG. 2 is a sectional view showing an arrangement of a process unit of the printer, FIG. 3 is a perspective view showing a toner cartridge and a mounting section of a developing device, FIG. 4 is a side view of a locking mechanism for locking the toner cartridge, and FIG. 5 is a plan view of an unlocking mechanism for unlocking the toner cartridge;

FIGS. 6 to 12C show a second embodiment of the invention, in which:

FIG. 6 is a perspective view showing a toner cartridge and a mounting section of a developing device, FIGS. 12A, 12B and 12C are a left-hand side view, a front view, and a right-hand side view, respectively, of the locking mechanism with the fourth toner cartridge mounted on the mounting section;

FIGS. 13 to 19B show a third embodiment of the invention, in which:

FIG. 13 is a perspective view showing a first toner cartridge and a mounting section of a developing device, FIG. 17 is a perspective view showing a second toner cartridge and the mounting section of the developing device, FIGS. 19A and 19B are a front view and a side view, respectively, of the locking mechanism with the second toner cartridge mounted on the mounting section;

FIGS. 20 to 28C show a fourth embodiment of the invention, in which:

FIG. 20 is a perspective view showing a toner cartridge and a mounting section of a developing device, FIG. 23 is a plan view showing the locking mechanism and an unlocking mechanism, FIGS. 28A, 28B and 28C are a left-hand side view, a front view, and a right-hand side view, respectively, of the locking mechanism with a fourth toner cartridge mounted on the mounting section;

DETAILED DESCRIPTION OF THE PREFERRED EMBODIMENTS

Preferred embodiments of the present invention will now be described in detail with reference to the accompanying drawings.

Figure 1:
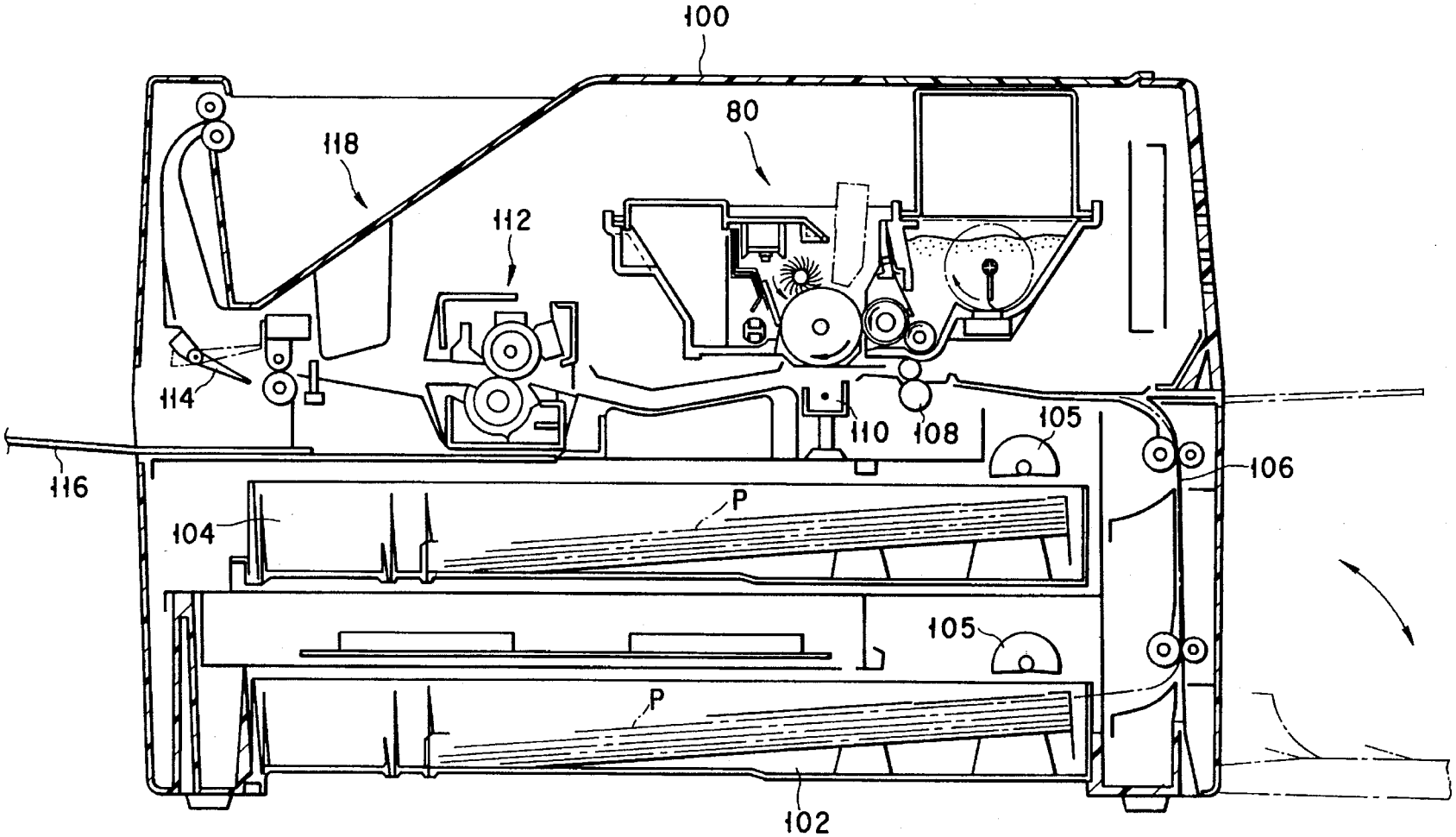

FIG. 1 shows an embodiment in which an image forming apparatus of the present invention is applied to a printer. The printer comprises a housing 100, in which a process unit 80 (mentioned later) is removably mounted, and first and second paper cassettes 102 and 104 are arranged under the unit 80. A pickup roller 105 is located in the vicinity of each of the paper cassettes 102 and 104. A paper sheet P taken out from each paper cassette by means of the roller 105 is delivered through a transportation path 106 to an aligning roller pair 108, whereupon it is aligned. Thereafter, the sheet P is transported to the position between a photoconductive drum 1 and a transfer charger 110 in the process unit 80. After a desired toner image is then transferred to the paper sheet P, the sheet is fed to a fixing device 112, and further transported through a distributing gate 114 to a discharge tray 116 or a paper discharge section 118 on the top surface of the housing 100.

Figure 2:
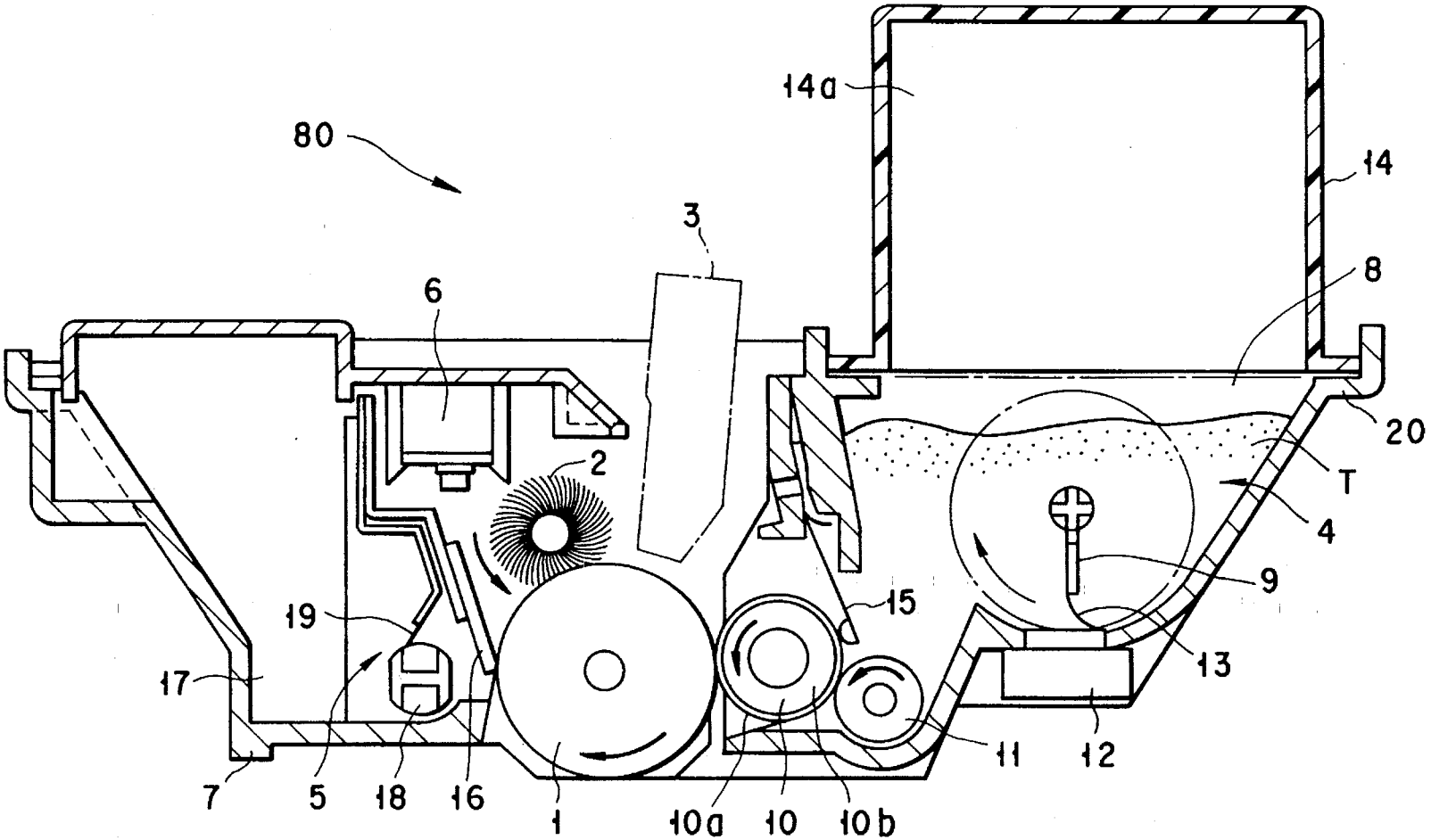

As shown in FIG. 2, the process unit 80, which is removably mounted in the housing 100, includes the photoconductive drum 1 for use as an image carrier, located substantially in the center of the unit 80 and rotatable in the direction indicated by the arrow. The drum 1 is formed of a photoconductive material based on an organic photoconductor (OPC). Further, the drum 1 is surrounded by a main charger 2, electrostatic latent image forming device 3, developing device 4, cleaner 5, and de-electrifier 6, which are arranged successively along the rotating direction of the drum.

The photoconductive drum 1, main charger 2, developing device 4, cleaner 5, and de-electrifier 6 are integrally supported by means of a supporting member 7, thus constituting the process unit 80.

The main charger 2 has a conductive brush roller, which is located at the upper portion the photoconductive drum 1, and is supplied with a voltage of −800 to −1,200 V. This brush roller is rotated in the direction of the arrow or in the direction opposite to the rotating direction of the drum 1 and at a speed 1.0 to 3.0 times that of the drum 1. Thus, the brush roller charges the surface of the drum 1 substantially uniformly to a negative voltage of −500 to −1800 V.

The electrostatic latent image forming device 3 is provided with an edge emitter head which has a large number of light emitting elements (LE elements) arranged in the axial direction of the photoconductive drum 1. This head projects light to the surface of the drum 1 in response to image information to be recorded, thereby forming an electrostatic latent image on a charged region of the drum.

The developing device 4, using a developer, develops the electrostatic latent image formed by the electrostatic latent image forming device 3. Thereafter, the developed image is transferred to the paper sheet P for use as a transfer medium by means of the transfer charger 110. The photoconductive drum 1 is cleared of the residual developer remaining thereon after the image transfer by the cleaner 5. The potential of the drum 1 is removed by the de-electrifier 6, and steady printing is achieved by repeating the printing routine described above.

The developing device 4 includes a toner storage section 8 which receives and stores a one-component developer or toner T as the developer having frictional chargeability. Arranged in the storage section 8 are an agitator 9 for moving the toner T to a developing region and agitating the toner, a developing roller 10 for supplying the toner to the photoconductive drum 1 and developing it by being in rolling contact with the drum 1, and an intermediate roller 11 for feeding the toner T to the developing roller 10.

A piezoelectric dust sensor 12, for use as toner amount detecting means for toner-empty detection, is disposed so as to be exposed to the inner wall surface of the toner storage section 8. A sheet member 13 for cleaning the sensor surface of the dust sensor 12 is attached to the distal end portion of the agitator 13. As the agitator 9 rotates, the sensor surface of the sensor 12 is cleaned up by the member 13.

Moreover, the developing device 4 is provided with a replaceable toner cartridge 14 for supplying toner to the toner storage section 8.

The developing roller 10 is composed of an elastic layer **10*b* of EPDM or the like covered by a conductive surface layer 10*a* of a conductive elastic resin having an electrical resistance of $10^2$ to $10^8$ Ωcm, thus constituting an elastic roller as a whole. The outer circumferential surface of the developing roller 10 is touched by an elastic blade 15 formed of phosphor bronze, urethane, or silicone resin, which is used to form a thin toner layer. As the toner T passes the elastic blade 15, it is frictionally charged to the same polarity, negative, as the photoconductive drum 1, thus forming one toner layer or two on the surface of the developing roller 10. Further, a bias source (not shown) is connected to the roller 10 so that the surface layer 10***a* is conducting. Thus, a given developing bias (−140 to −1,400 V) is applied to the surface layer 10*a* at the time of developing.

The cleaner 5 includes an elastic blade 16 for clearing the photoconductive drum 1 of the residual toner by touching the drum, a waste toner receiving section 17 for receiving the toner separated from the drum 1, a toner transportation mechanism 18 for transporting the separated toner into the receiving section 17, and a toner arresting mechanism 19 for preventing a back flow of the toner by engaging the transportation mechanism 18.

The capacity of the waste toner receiving section 17 depends on the set working life (quantity of prints) and transfer efficiency of the process unit 80. In the present embodiment, the capacity of the toner storage section 8 is set to be smaller than that of the toner cartridge 14, so that the process unit 80 is reduced in size.

Figure 3:
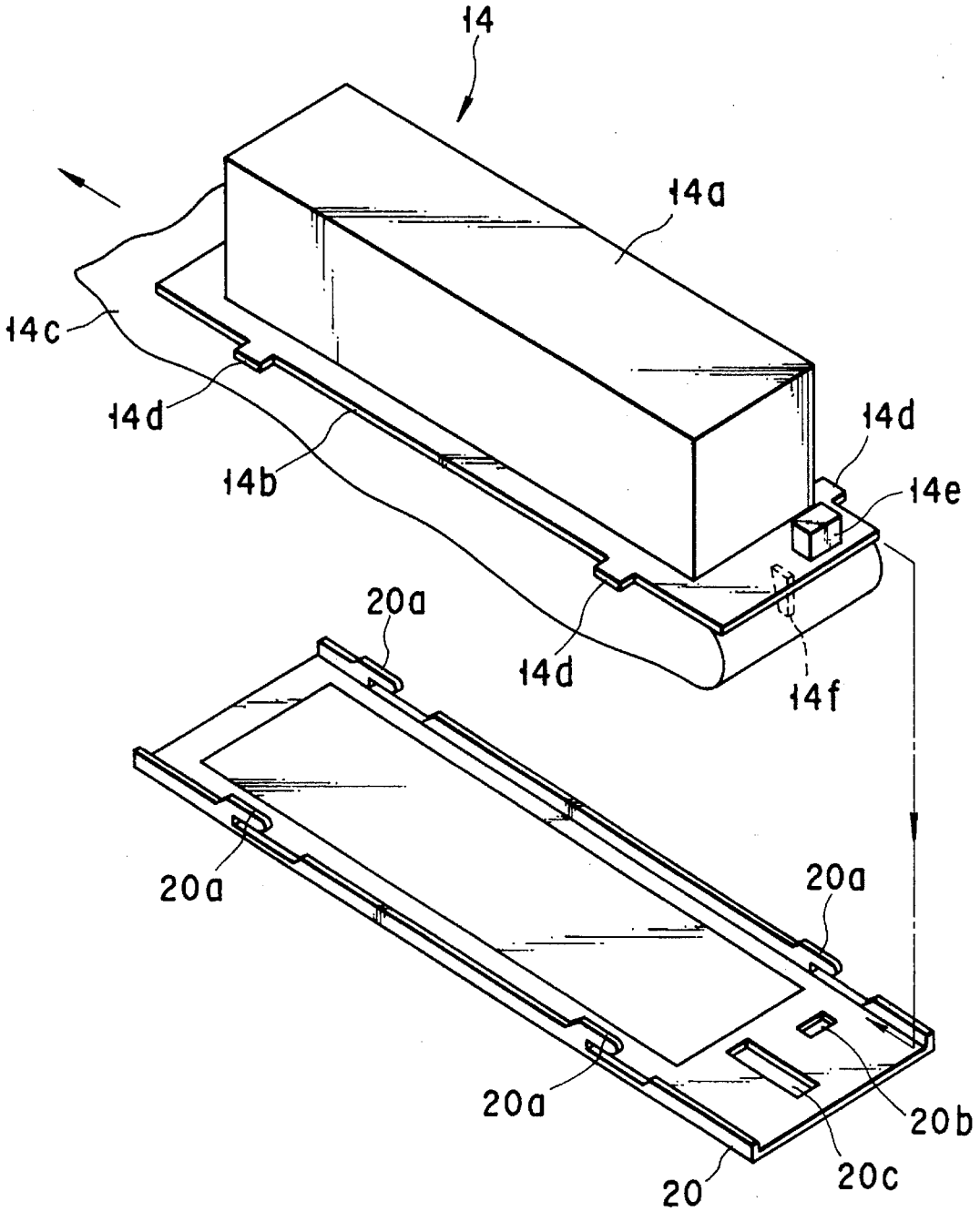

FIG. 3 shows an arrangement of a mounting section of the toner cartridge 14 to be mounted on the developing device 4. The cartridge 14 includes a toner storage portion 14*a* in the form of an open-bottomed rectangular box, a base plate 14*b* on the peripheral edge of the bottom opening of the storage portion 14*a*, and a film 14*c* attached to the lower surface of the base plate 14*b* so as to close the bottom opening of the storage portion 14*a*. The toner in the toner storage portion 14*a* can be supplied to the toner storage section 8 of the developing device 4 by stripping off the film 14*c* in the direction of the arrow after the cartridge 14 is mounted on the developing device 4.

A plurality of lugs 14*d* protrude laterally from both side edges of the base plate 14*b* which extend in the lengthwise direction of the toner storage section 14*a*. An engaging recess 14*e* and an engaging projection 14*f* for locking the toner cartridge are formed individually on the upper and lower surface, respectively, of a lengthwise end portion of the base plate 14*b* on the side opposite to the film stripping direction.

A mounting section 20 for the toner cartridge 14 is formed on the upper surface of the developing device 4. The section 20 is provided with a plurality of retaining portions 20*a* which engage the lugs 14*d* of the cartridge 14, individually, when the cartridge 14 is mounted on the section 20 and slid in the lengthwise direction of the section 20. Also, the mounting section 20 is formed having windows 20*b* and 20*c*. The window 20*b* is situated so that it faces the engaging recess 14*e* when the lugs 14*d* engage their corresponding retaining portions 20*a*. The window 20*c* is an elongate slot in which the engaging projection 14*f* is inserted and moves as the toner cartridge 14 slides.

Figure 4:
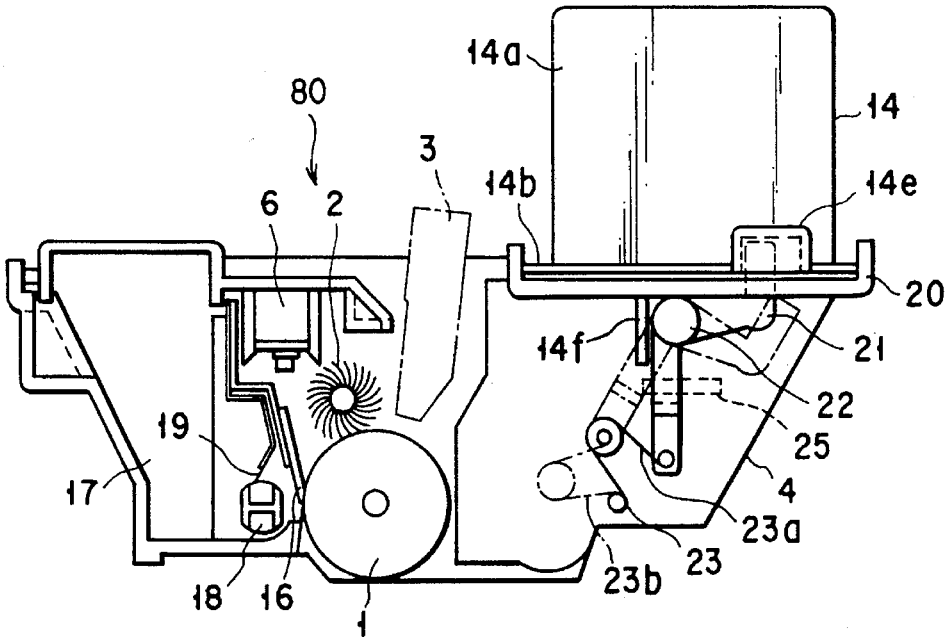

As shown in FIG. 4, a locking member 21 for locking the toner cartridge 14 is rockably mounted, by means of a shaft 22, on the flank portion of the developing device 4 in that region where the engaging recess 14*e* and the engaging projection 14*f* of the cartridge 14 are situated when the cartridge 14 is mounted on the mounting section 20. One end of a torsion coil spring 23 is connected to one end portion of the locking member 21. The coil spring 23 serves to hold the member 21 alternatively in at least two positions. The other end of the spring 23 is anchored to the developing device 4.

When the coil spring 23 is in a position 23*a* indicated by full line in FIG. 4, the locking member 21 is held in a locking position indicated by full line. When the spring 23 is in a position 23*b* indicated by broken line, the member 21 is held in an unlocking position indicated by dashed line.

When the apparatus is unpacked before use, the toner cartridge 14 is not mounted on the developing device 4 of the process unit 80, and the locking member 21 is held in the unlocking position. When the cartridge 14 is mounted in this state, the engaging projection 14*f* of the cartridge 14 is inserted into the window 20*c* of the mounting section 20, and its distal end portion presses the member 21 to rock it. Thereupon, the locking member 21 is held in the locking position by the torsion coil spring 23. The engaging projection 14*f* is designed so as to be disengaged from the member 21 before the lugs 14*d* of the cartridge 14 are fitted individually in the retaining portions 20*a* of the mounting section 20.

When the toner cartridge 14 is moved to the position where its lugs 14*d* are caught by their corresponding retaining portions 20*a* of the mounting section 20, the distal end portion of the locking member 21 gets into the engaging recess 14*e* through the window 20*b*, as indicated by full line in FIG. 4, thereby locking the cartridge 14.

Figure 5:
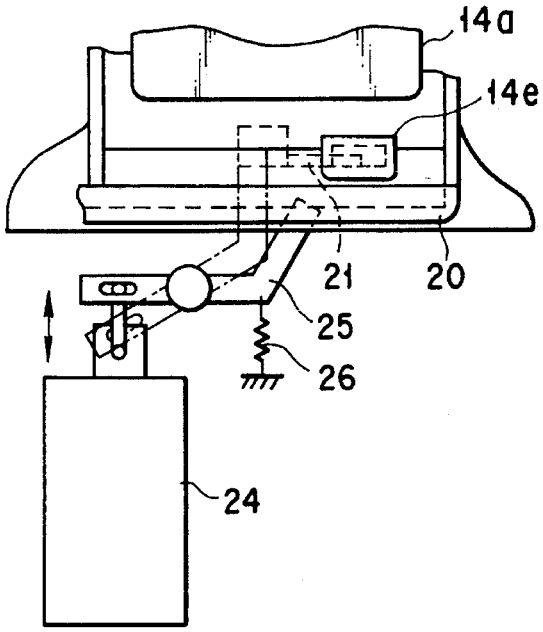

FIG. 5 schematically shows a state in which the process unit 80 is mounted in the housing 100 of the printer. The housing 100 contains a solenoid 24 for use as drive means, which operates in response to a toner-empty detection signal from the dust sensor 12, and an unlocking member 25 having one end portion coupled to the solenoid 24. The unlocking member 25 is held in its nonoperating position (indicated by full line) by means of a spring 26 when the printer is not connected to the power supply, when a toner-empty state is not detected by the dust sensor 12, or when the process unit 80 is not mounted in the housing 100. When the sensor 12 detects the toner-empty state or that the amount of the toner in the toner storage section 8 is reduced below a predetermined value, the solenoid 24 is actuated to attract the one end portion of the unlocking member 25 against the urging force of the spring 26, thereby rocking the member 25 to its operating position, as indicated by dashed line in FIG. 5. Thereupon, the other end portion of the unlocking member 25 causes the locking member 21 to rock to the unlocking position.

According to the printer constructed in this manner, when the toner cartridge 14 is mounted on the developing device 4 with the lugs 14*d* of the cartridge 14 in engagement with the retaining portions 20*a* of the mounting section of the device 4, the distal end portion of the locking member 21 gets into the engaging recess 14*e*, thereby locking the cartridge 14. As a result, the toner cartridge 14 becomes unable to be disengaged from the developing device 4. When the film 14*c* is stripped from the base plate 14*b* of the cartridge 14 in this state, the toner is supplied from the toner storage section 14*a* to the toner storage section 8.

As the process unit 80 is operated, thereafter, the toner in the toner storage section 8 is used. When the amount of the toner in the section 8 is reduced below the predetermined value, the dust sensor 12 detects the toner-empty state. As a result, the solenoid 24 is actuated to rock the unlocking member 25 to the operating position. As the member 25 rocks in this manner, the locking member 21 is rocked to the unlocking position, so that its distal end portion is disengaged from the engaging recess 14*e*. Thereupon, the toner cartridge 14 is allowed to be removed from the process unit 80 for replacement.

Accordingly, the toner cartridge 14 cannot be replaced unless the amount of the toner in the toner storage section 8 decreases below the predetermined value, so that the section 8 is in the toner-empty state whenever the cartridge 14 is replaced. Thus, the toner can be prevented from overflowing the toner storage section 8 during the replacement of the toner cartridge 14.

In the first embodiment described above, the locking member 21 for locking the toner cartridge 14 is supported on the developing device 4. Alternatively, however, it may be supported on the supporting member 7 of the process unit 80, for example. Although the toner-empty sensor is used as the toner amount detecting means according to the first embodiment, moreover, it may be replaced with any other suitable means which can detect the reduction of the toner below the predetermined value, without departing from the scope or spirit of the invention.

FIGS. 6 to 12C show a process unit of a printer according to a second embodiment of the present invention. In the description of the second embodiment to follow, like reference numerals are used to designate the same portions as in the first embodiment, and a detailed description of those portions will be omitted.

In the life management of a conventional process unit of the toner cartridge type, the print ratio (ratio of toner area to blank area) of the transfer medium varies depending on the user. In a method to cope with this, the life of the process unit is determined by the quantity of prints corresponding to the set life (set print ratio) of the process unit or the frequency of detection of the toner-empty state indicative of the time for toner consumption corresponding to the lifetime print quantity for the process unit, whichever is shorter.

According to this method, however, if the user employs a high print ratio (for a solid image in an extreme case) for print-out when the toner cartridge is replaced before the toner-empty state is detected, the life of the process unit can be determined only by the quantity of prints. Moreover, the high-ratio printing entails a very large toner consumption. Accordingly, the waste toner receiving section for receiving the residual toner removed from the photoconductive drum requires a very large capacity. The present embodiment solves this problem.

Figure 6:
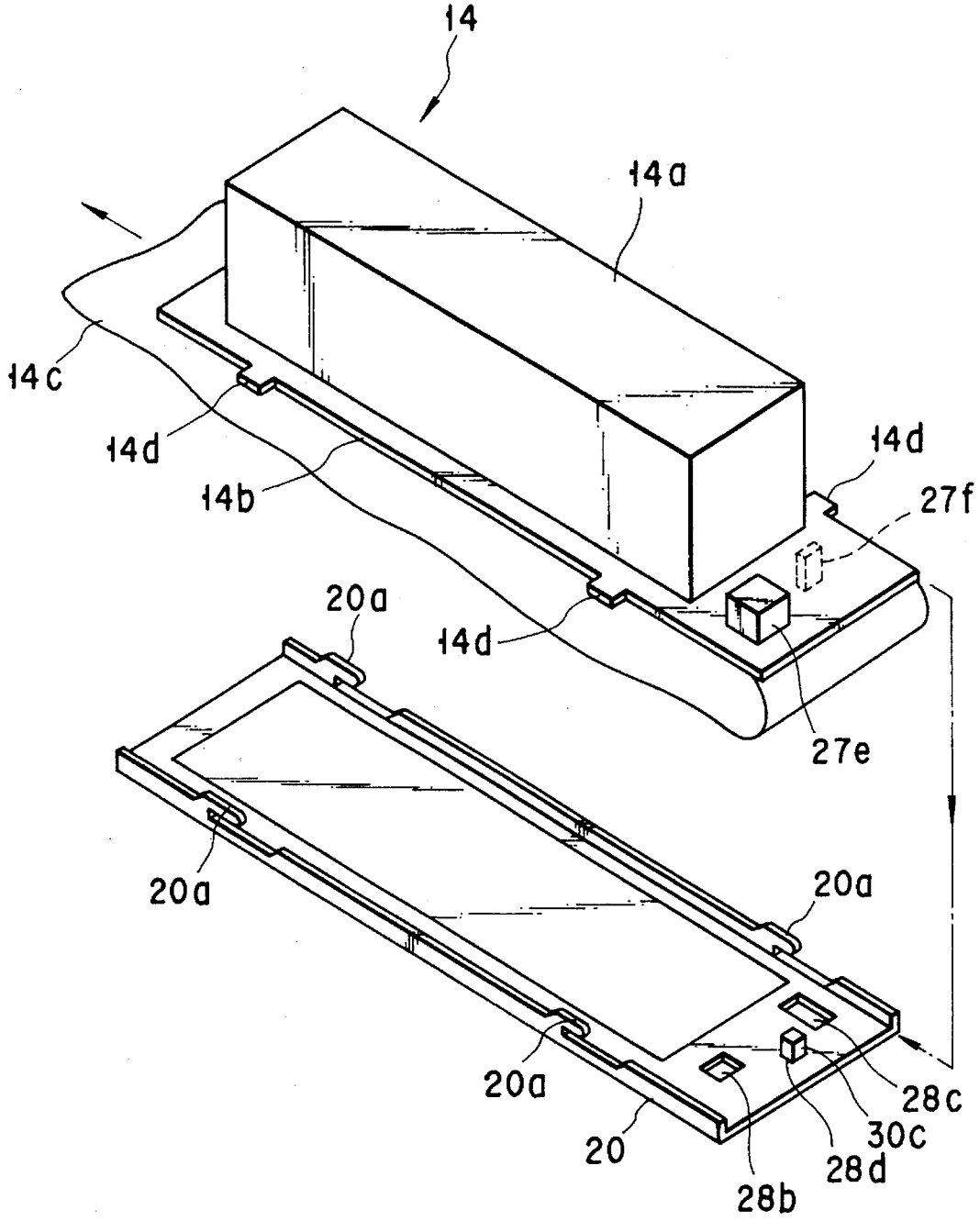

According to the second embodiment, as shown in FIG. 6, an engaging recess 27*e* and an engaging projection 27*f* for locking a toner cartridge 14 are formed individually on the upper and lower surface, respectively, of a lengthwise end portion of a base plate 14*b* of the cartridge 14 on the side opposite to the stripping direction for a film 14*c*.

A mounting section 20 for the toner cartridge 14, which is formed on the upper surface of a developing device 4, is provided with windows 28*b* and 28*c*. The window 28*b* is situated so that it faces the engaging recess 27*e* when lugs 14*d* of the cartridge 14 are located so as to engage their corresponding retaining portions 20*a*. The window 28*c* is an elongate slot in which the engaging projection 27*f* is fitted and moves as the cartridge 14 slides. Further, the mounting section 20 is provided with a window 28*d* in which a projection 30*c* of a rotation assist member 30 (mentioned later) is inserted.

Figure 7A:
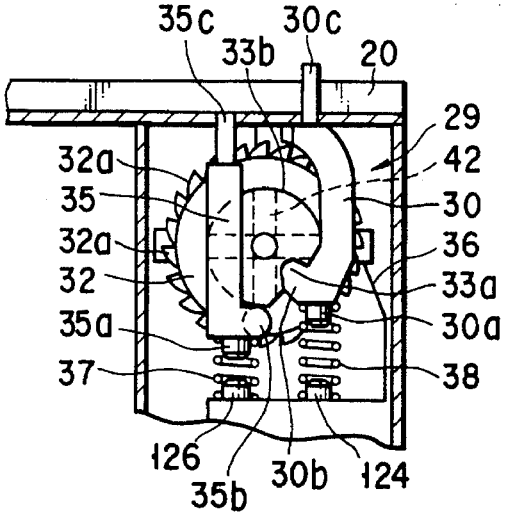
FIGS. 7A, 7B and 7C are a left-hand side view, a front view, and a right-hand side view, respectively, of a locking mechanism for locking the toner cartridge.
Figure 7B:
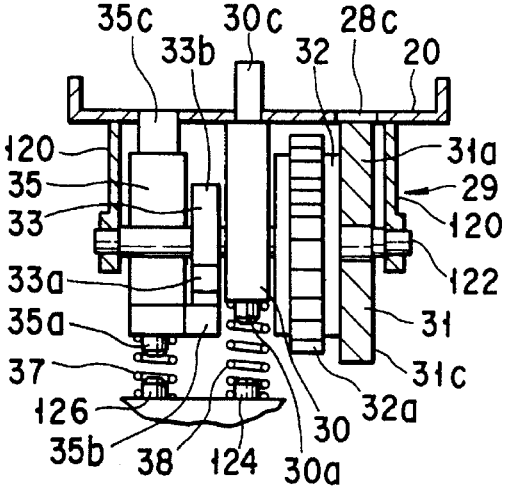
Figure 7C:
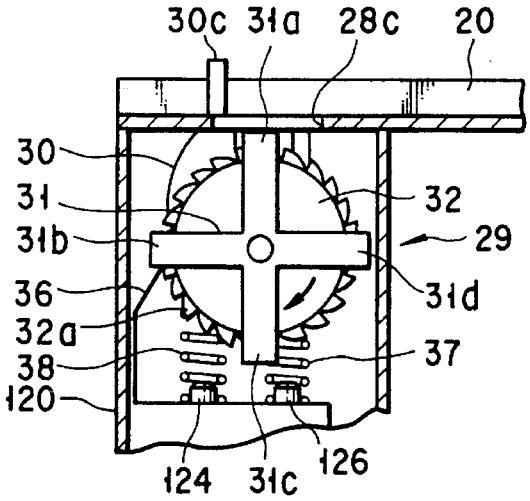

FIGS. 7A, 7B and 7C show an arrangement of a locking mechanism 29 which is mounted on the developing device 4 and serves to lock the toner cartridge 14.

The locking mechanism 29 includes a rotating shaft 122 supported at both ends by means of a supporting frame 120, which is fixed to the mounting section 20 of the developing device 4. The shaft 122 is fitted with a plurality of rotating members which rotate for a fixed angle when the toner cartridge 14 is mounted on the section 20. The rotating members include a runner 31, engaging cylinder 32, cam 33, and angle adjusting member 42, which are fixed on the shaft 122 and rotatable integrally therewith.

The runner 31 is formed of a resin, such as polyacetal, and has four arms 31*a*, 31*b*, 31*c* and 31*d*, which correspond in number to the maximum available toner cartridges for the developing device 4. These arms extend radially from the rotating shaft 122, and are arranged at regular intervals in the circumferential direction. The runner 31 is located opposite the window 28*c* of the mounting section 20 so that the extending end of each arm moves near the window 28*c* as the runner rotates. When the engaging projection 27*f* of the toner cartridge 14 moves in the window 28*c* as the cartridge 14 is mounted on the mounting section 20, the extending end of one of the arms is pressed by the engaging projection 27*f*, so that the runner 31 and the shaft 122 are rotated integrally for a certain angle.

A large number of engaging teeth 32*a* are formed on the outer circumferential surface of the engaging cylinder 32. The number of these teeth 32*a* is adjusted to an integer multiple of the maximum available toner cartridge number (four). A stopper 36, which is formed of a leaf spring, is fixed to the supporting frame 120. This stopper engages each of the engaging teeth 32*a* so that the cylinder 32 is allowed to rotate only in one direction or is restrained from rotating in the other direction.

The cam 33 has an arcuate cam face 33*b* coaxial with the rotating shaft 122 and a recess 33*a* formed by notching part of the cam face.

The angle adjusting member 42 is situated between the engaging cylinder 32 and the cam 33, and has at least as many arm portions as the maximum available cartridges. These arm portions extend radially from the rotating shaft 122, and are arranged at regular intervals in the circumferential direction.

The locking mechanism 29 further includes the rotation assist member 30 and a locking member 35. The assist member 30 keeps the respective rotational angles of the rotating shaft 122 and the rotating members fixed thereon uniform when the toner cartridge 14 is mounted. The locking member 35 engages the cartridge 14 to lock it so that the cartridge 14 cannot be disengaged from the developing device 4 when the last one of the maximum available toner cartridges 14 is mounted on the mounting section 20.

The rotation assist member 30, which extends at right angles to the mounting section 20, includes the engaging projection 30*c* at its mounting-section-side end and a spring retainer 30*a* projecting on the other end side. The other end of the member 30 is bent toward the rotating shaft 122, thus forming a press portion 30*b* which can engage the arm portions of the angle adjusting member 42. The projection 30*c* is fitted in the window 28*d* of the mounting section 20. A compression spring 38 is interposed between the spring retainer 30*a* and another spring retainer 124 which is provided on the developing device 4 so as to face the retainer 30*a*. The 10 rotation assist member 30 is urged toward the mounting section 20 by the spring 38. Normally, therefore, the member 30 is moved toward the mounting section 20 so that the engaging projection 30*c* projects upward through the window 28*d*.

The locking member 35, which extends at right angles to the mounting section 20, includes an engaging projection 35*c* at its mounting-section-side end, a spring retainer 35*a* projecting on the other end side, and a columnar cam follower 35*b* protruding from the other end and in engagement with the cam face 33*b* of the cam 33. The distal end of the projection 35*c* is fitted in the window 28*b* of the mounting section 20. A compression spring 37 is interposed between the spring retainer 35*a* and another spring retainer 126 which is provided on the developing device 4 so as to face the retainer 35*a*. The locking member 35 is urged toward the mounting section 20 by the spring 37 so that the cam follower 35*b* is pressed against the cam face 33*b*.

FIGS. 8A to 12C illustrate the way the maximum available toner cartridges 14 of the same configuration for the process unit 80, four in number, are mounted successively on the developing device 4.

Figure 8A:
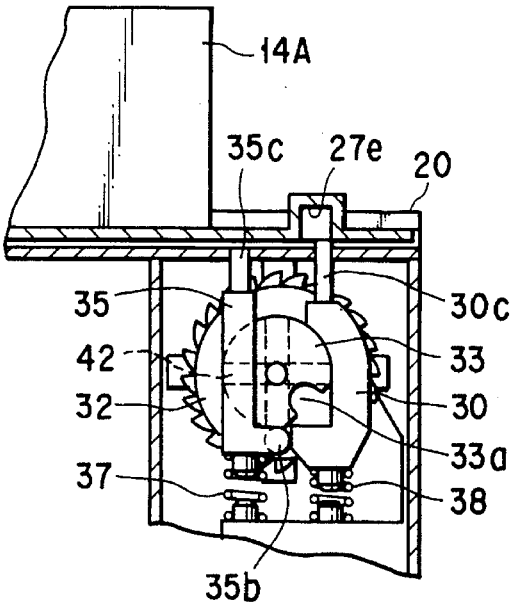
FIGS. 8A, 8B and 8C are a left-hand side view, a front view, and a right-hand side view, respectively, of the locking mechanism with a first toner cartridge placed on the mounting section.
Figure 8B:
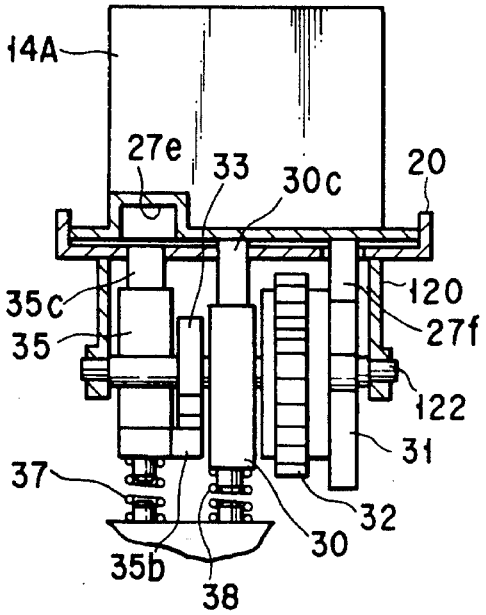
Figure 8C:
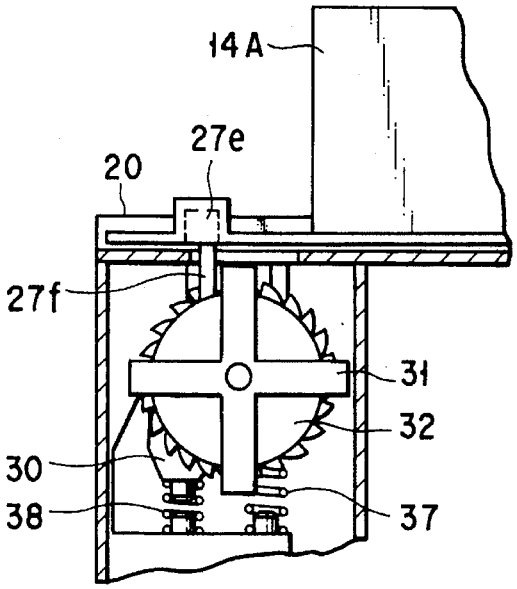

When a first toner cartridge 14A is mounted on the mounting section 20 of the developing device 4, as shown in FIGS. 8A, 8B and 8C, the engaging projection 30*c* of the rotation assist member 30, which projects through the window 28*d* of the section 20, is pushed in by the base plate 14*b* of the cartridge 14A. At the same time, the engaging projection 27*f* of the cartridge 14A is inserted in the window 28*c* of the mounting section 20, and faces one of the arms of the runner 31.

Figure 9A:
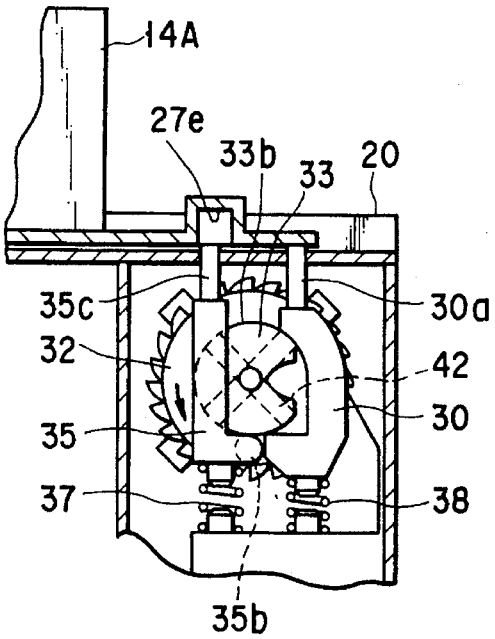
FIGS. 9A, 9B and 9C are a left-hand side view, a front view, and a right-hand side view, respectively, of the locking mechanism with the first toner cartridge mounted on the mounting section.
Figure 9B:
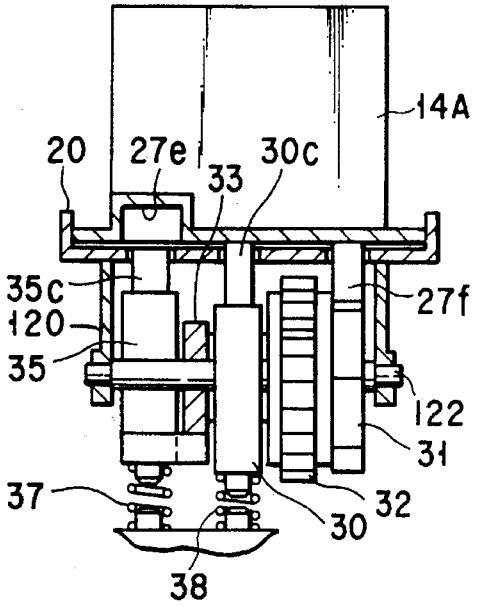
Figure 9C:
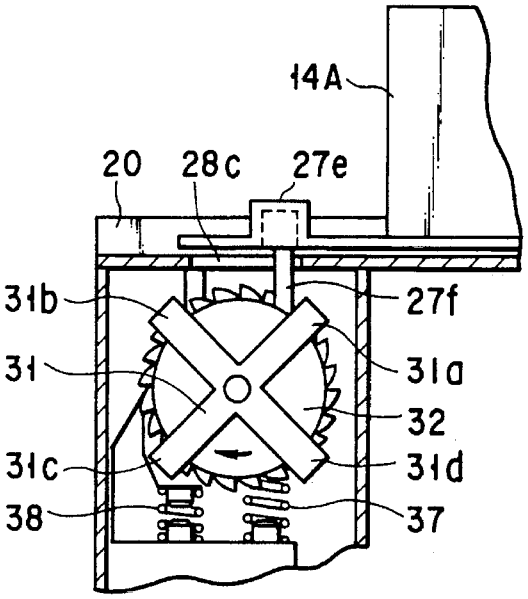

When the toner cartridge 14A is slid to the position where its lugs 14*d* are caught by their corresponding retaining portions 20*a* of the mounting section 20, its engaging projection 27*f* presses the arm 31*a* of the runner 31, as shown in FIGS. 9A, 9B and 9C, thereby rotating the runner and the rotating shaft 122 for a predetermined angle θ. As the shaft 122 rotates in this manner, the angle adjusting member 42 and the cam 33 also rotate for the angle θ. In the meantime, the cam follower 35*b* of the locking member 35 moves on the arcuate cam face 33*b*, so that the member 35 is kept in a position such that its engaging projection 35*c* is recessed as illustrated.

Figure 10A:
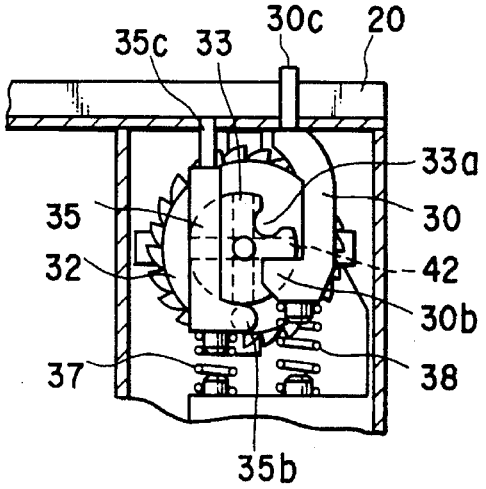
FIGS. 10A, 10B and 10C are a left-hand side view, a front view, and a right-hand side view, respectively, of the locking mechanism with the first toner cartridge off the mounting section.
Figure 10B:
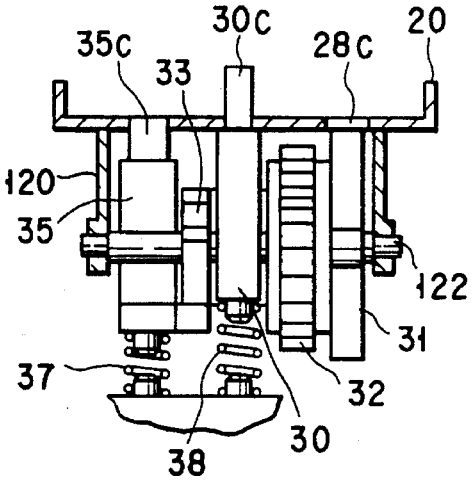
Figure 10C:
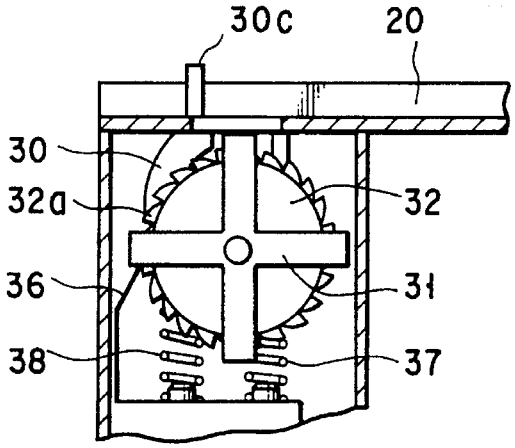

When the first toner cartridge 14A is removed from the mounting section 20 to be replaced with another one, the compression spring 38, having so far been compressed downward by the rotation assist member 30 pressed by the cartridge 14A, is released, so that the member 30 is urged upward by the spring 38 so that its engaging projection 30*c* projects above the mounting section 20 through the window 28*d*, as shown in FIGS. 10A, 10B and 10C. At this time, the press portion 30*b* of the assist member 30 engages and pushes up one of the arms of the angle adjusting member 42, thereby rotating the member 42 for a predetermined angle. In response to this, the rotating shaft 122, cam 33, and engaging cylinder 32 are also rotated for the predetermined angle. In the present embodiment, the maximum available toner cartridge number is four, and the rotating members are designed so as to rotate for 90° every time each toner cartridge is mounted or removed. Accordingly, the angle adjusting member 42 is rotated for an angle equal to 90°−θ.

Thus, when the cartridge 14A is mounted, the rotating members are rotated for the angle θ by the engaging projection 27*f* of the cartridge. When the cartridge 14A is removed for replacement, on the other hand, the rotating members are rotated for the angle equal to 90°−θ by the angle adjusting member 42. As a whole, the rotating shaft 122 and the rotating members fixed thereon rotate for 90°.

In this manner, the rotating members rotate for 90° with every replacement of the toner cartridge, and the processes of operation shown in FIGS. 8A to 10C are repeated three times so that a third toner cartridge (i.e., the last of the maximum available cartridges but one) is mounted and removed.

Figure 11A:
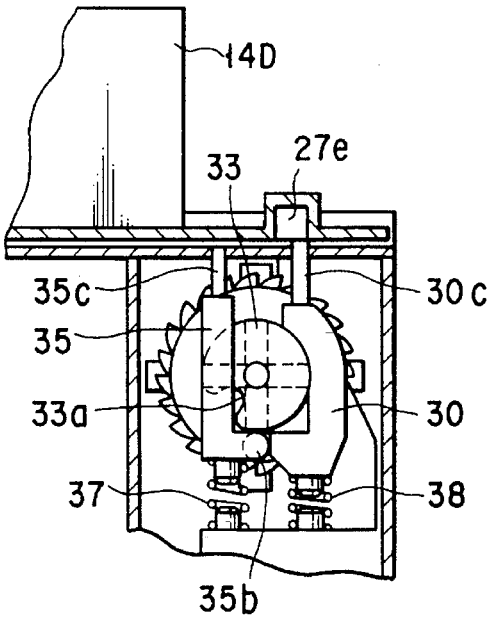
FIGS. 11A, 11B and 11C are a left-hand side view, a front view, and a right-hand side view, respectively, of the locking mechanism with a fourth toner cartridge placed on the mounting section.
Figure 11B:
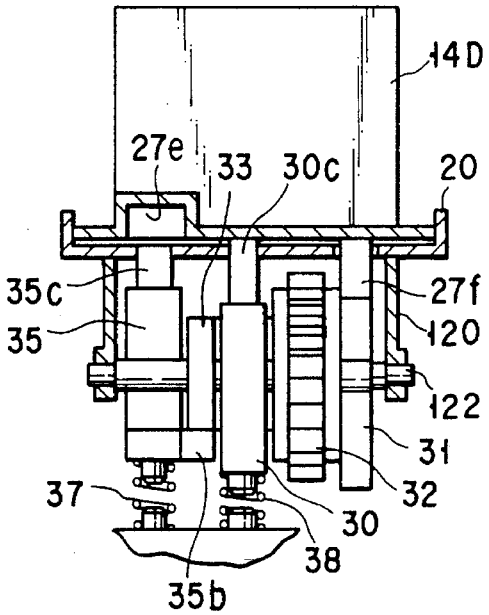
Figure 11C:
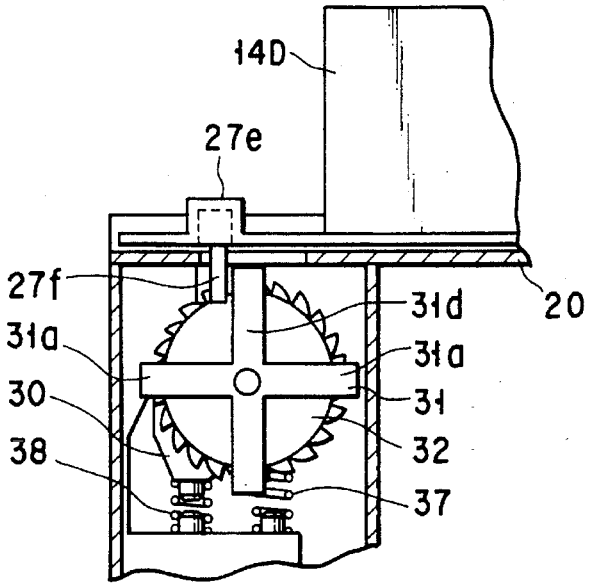

In mounting a fourth toner cartridge (i.e., the last of the maximum available cartridges) 14D on the mounting section 20, as shown in FIGS. 11A, 11B and 11C, the rotation assist member 30, having its engaging projection 30*c* projecting above the section 20, is pushed down by the cartridge 14D, and the engaging projection 27*f* of the cartridge 14D is inserted into the window 28*c* of the mounting section 20.

When the toner cartridge 14D is slid so that its lugs 14*d* are caught by their corresponding retaining portions 20*a* of the mounting section 20, its engaging projection 27*f* presses the arm 31*d* of the runner 31, thereby rotating the runner for the predetermined angle θ.

Figure 12A:
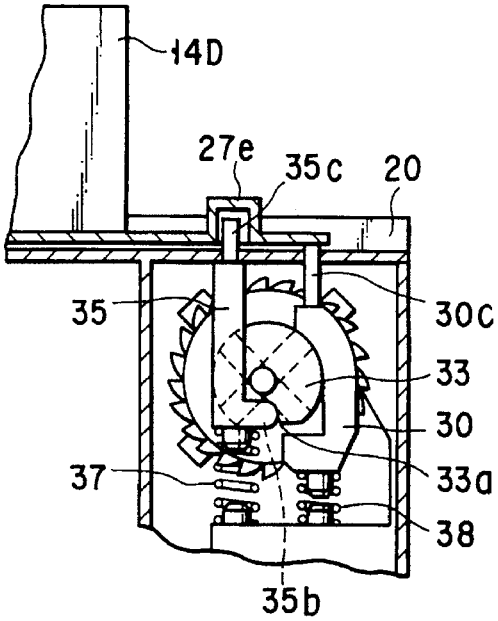
Figure 12B:
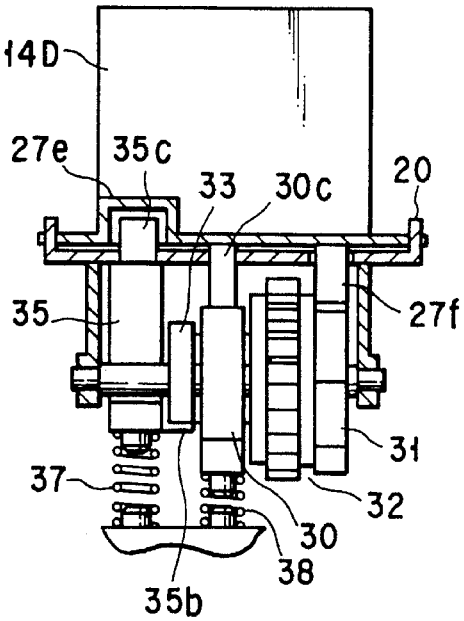
Figure 12C:
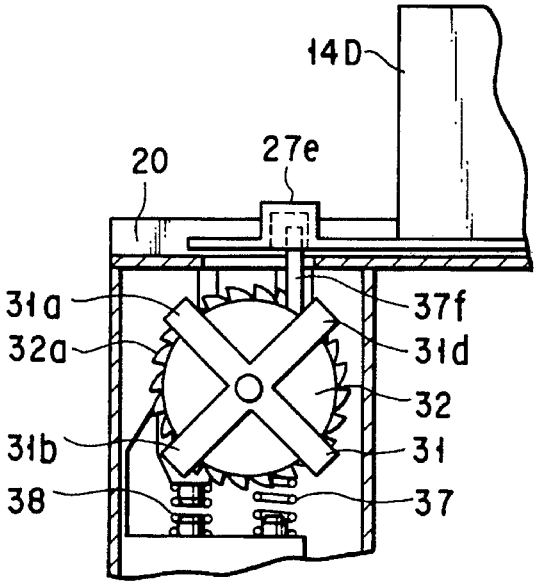

In the meantime, the cam 33, along with the rotating shaft 122, rotates for the angle θ so that its recess 33*a* faces the cam follower 35*b* of the locking member 35. Thereupon, the locking member 35 is urged to rise by the compression spring 37. As a result, the cam follower 35*b* of the member 35 is fitted in the recess 33*a* of the cam 33, so that the member 35 is held in its locking position, as shown in FIGS. 12A, 12B and 12C. In this locking position, the locking member 35 projects upward through the window 28*b* of the mounting section 20, and is fitted in the engaging recess 27*e* of the toner cartridge 14D. Thus, the cartridge 14D is locked so that it cannot be disengaged from the mounting section 20 of the developing device 4.

When the fourth or last one of the maximum available toner cartridges is mounted on the mounting section 20 in this manner, the cartridge is locked to the section 20 by means of the locking member 35. Even when the toner cartridges are replaced before a toner-empty state of a toner storage section of the developing device 4 is detected, therefore, the available cartridges are only four in number without regard to the user's print ratio. Accordingly, the amount of the toner supplied to the developing device 4 of the process unit 80 is restricted, so that the waste toner amount can be minimized. In consequence, a waste toner receiving section 17 can be designed having a minimum capacity for the waste toner, so that the process unit can be reduced in size.

Since the toner cartridges of just the same configuration can be used, moreover, a remarkable advantage can be enjoyed if the maximum available toner cartridge number is large.

Although the present embodiment has been described on the assumption that the maximum available toner cartridge number is four, it is to be understood that the maximum available cartridge number may be adjusted to two or more without departing from the scope or spirit of the invention.

FIGS. 13 to 19B show toner cartridges and a locking mechanism therefor adapted for use in a printer according to a third embodiment of the present invention. In the description to follow, like reference numerals are used to designate the same portions as in the first embodiment, and a detailed description of those portions is omitted.

According to the third embodiment, the maximum number of available toner cartridges 14 is two, and the two cartridges have different configurations.

Figure 13:
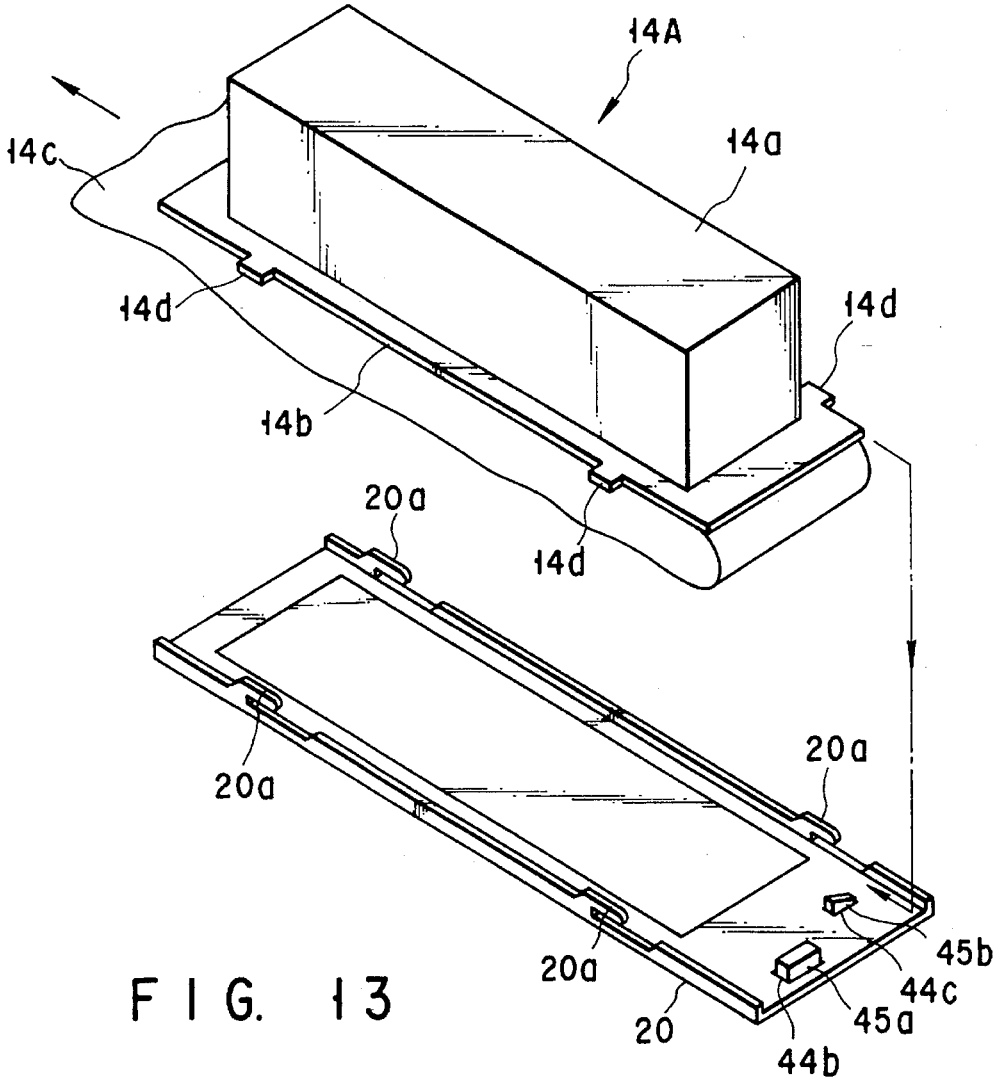

As shown in FIG. 13, a first toner cartridge 14A, like the one according to the first embodiment, includes a toner storage portion 14*a*, a base plate 14*b* having a plurality of lugs 14*d*, and a film 14*c*. Moreover, a mounting section 20 of a developing device 4 is formed having windows 44*b* and 44*c* in the region which is exposed when the lugs 14*d* of the cartridge 14A are in positions to engage their corresponding retaining portions 20*a*. Engaging projections 45*a* and 45*b* of an unlocking lever 45 (mentioned later) are passed through the windows 44*b* and 44*c*, respectively.

Figure 14A:
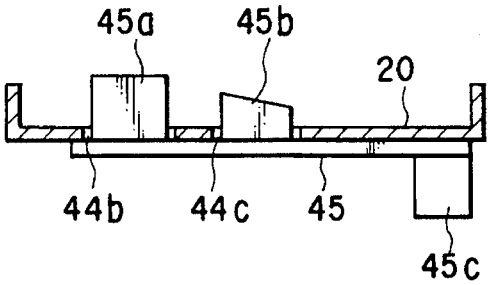
FIGS. 14A and 14B are a front view and a side view, respectively, of a locking mechanism with no toner cartridge mounted.
Figure 14B:
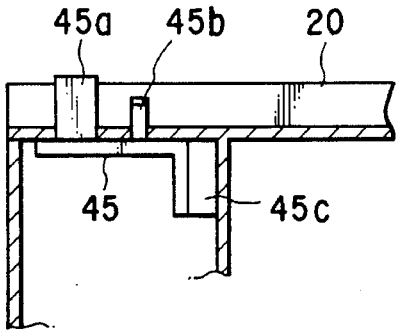

As shown in FIGS. 14A and 14B, the unlocking lever 45 is provided on the underside of the mounting section 20. The lever 45 is a plate formed of an elastic resin, such as PP (polypropylene), ABS (acrylonitrile-butadiene-styrene), or PE (polyethylene), and its supporting portion 45*c* is fixed to the section 20. Normally, the lever 45 is kept in contact with the lower surface of the mounting section 20 by its own elasticity. The unlocking lever 45 includes the projections 45*a* and 45*b* which project upward through the windows 44*b* and 44*c*, respectively. The projection 45*a* forms an unlocking portion which is manually depressed by the user, and the projection 45*b* forms a locking portion which engages an end edge of the toner cartridge 14A, thereby locking the cartridge in its mounted position. The distal end of the locking portion 45*b* is declined toward the supporting portion 45*c*. The unlocking portion 45*a* and the locking portion 45*b* are arranged with an offset in the mounting direction of the cartridge 14A such that the cartridge can be mounted or removed without hindrance. The unlocking lever 45 is elastically deformed by manually depressing the unlocking portion 45*a*, whereby the locking portion 45*b* is disengaged from the toner cartridge 14A.

Figure 15A:
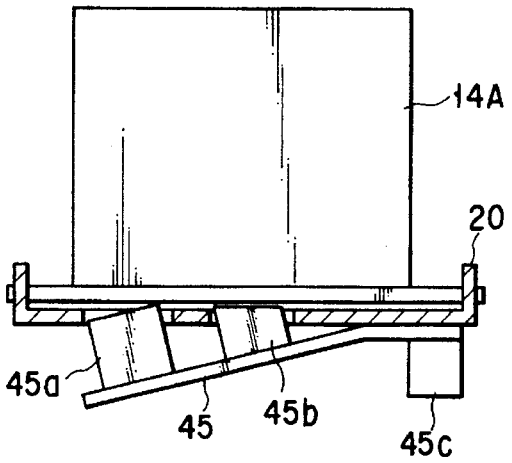
FIGS. 15A and 15B are a front view and a side view, respectively, of the locking mechanism with the first toner cartridge placed on the mounting section.
Figure 15B:
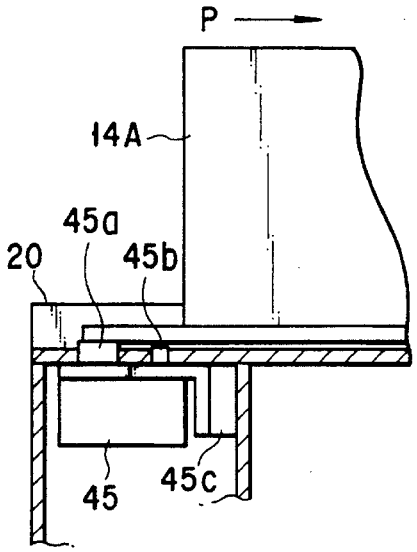
Figure 16A:
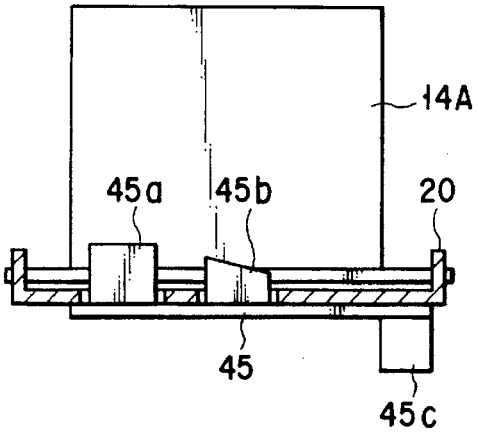
FIGS. 16A and 16B are a front view and a side view, respectively, of the locking mechanism with the first toner cartridge mounted on the mounting section.
Figure 16B:
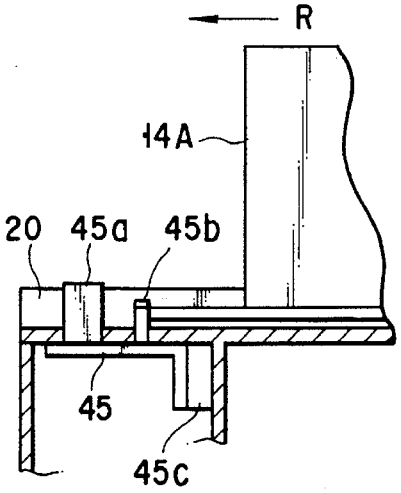

In mounting the first toner cartridge 14A on the mounting section 20 of the developing device 4, as shown in FIGS. 15A and 15B, the unlocking portion 45*a* of the unlocking lever 45 is pressed down to depress the locking portion 45*b* into the window 44*c* of the section 20. In this state, the cartridge 14A is placed on the mounting section 20, slid in the direction of arrow P, and held in place on the section 20. When the force of depression on the unlocking portion 45*a* is then removed, the locking lever 45 is restored to the position where it is in contact with the lower surface of the mounting section 20, so that the unlocking portion 45*a* and the locking portion 45*b* project above the upper surface of the section 20 through the windows 44*b* and 44*c*, respectively, as shown in FIGS. 16A and 16B. Thereupon, the locking portion 45*b* engages the end edge of the toner cartridge 14A, thereby locking the cartridge in the mounted state.

Thereafter, the developing device 4 is replenished with the toner by pulling the film 14*c* on the bottom surface of the toner cartridge 14A in the direction of the arrow of FIG. 13.

In removing the toner cartridge 14A, the unlocking portion 45*a* is pressed down to disengage the locking portion 45*b*, as shown in FIGS. 15A and 15B, and the cartridge is then slid in the direction of arrow R of FIG. 16B.

Figure 17:
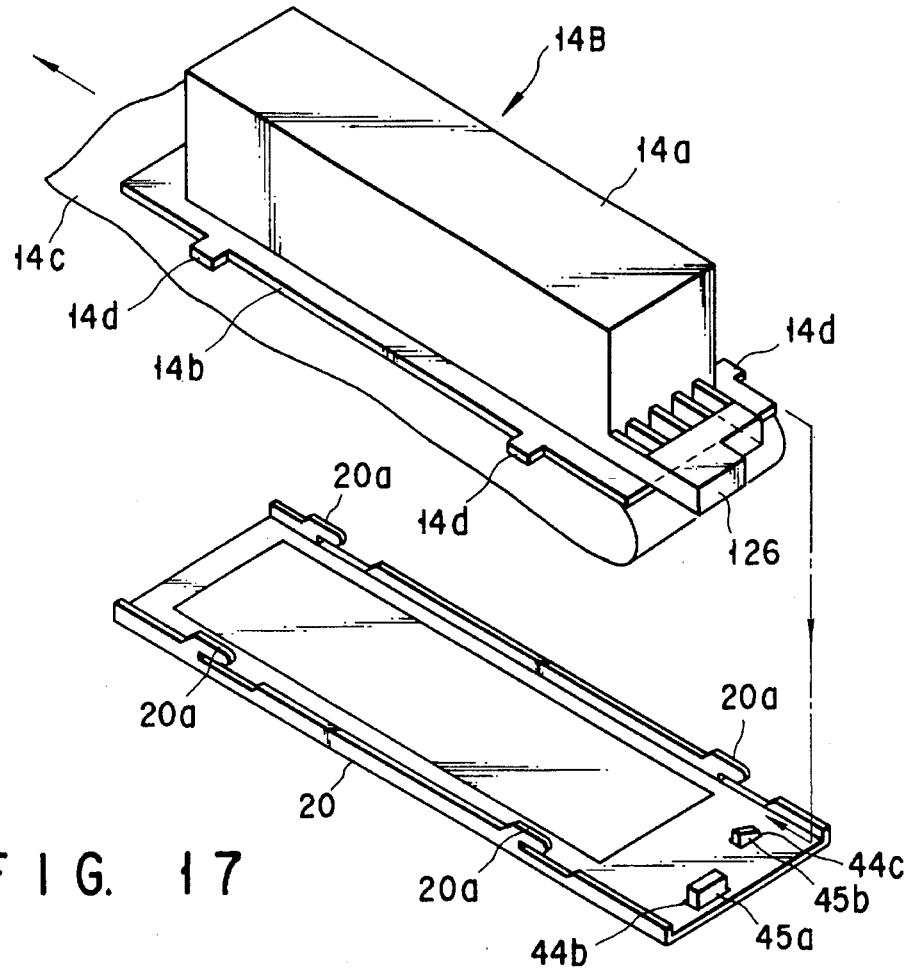
Figure 18A:
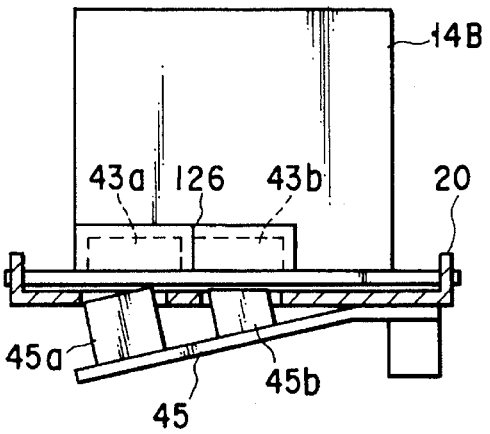
FIGS. 18A and 18B are a front view and a side view, respectively, of the locking mechanism with the second toner cartridge placed on the mounting section.
Figure 18B:
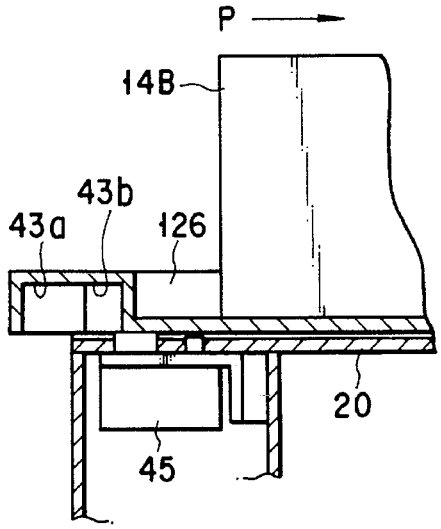
Figure 19A:
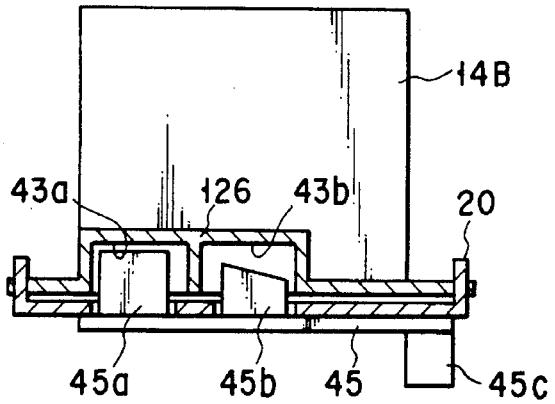
Figure 19B:
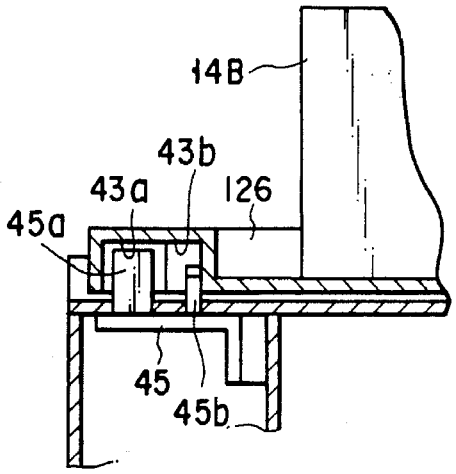

As shown in FIGS. 17, 18A and 18B, a second toner cartridge 14B has a configuration different from that of the first toner cartridge 14A. More specifically, the cartridge 14B has a cover 126 at its lengthwise end portion on the side opposite to the stripping direction for a film 14*c*. The cover 126 defines first and second engaging recesses 43*a* and 43*b* for locking.

When the force of depression on the unlocking lever 45 is removed after the second toner cartridge 14B is mounted on the mounting section 20 with the locking portion 45*b* of the unlocking lever 45 depressed by pressing the unlocking portion 45*a*, as shown in FIGS. 18A to 19B, the unlocking portion 45*a* and the locking portion 45*b* of the lever 45 are fitted into the first and second engaging recesses 43*a* and 43*b*, respectively, of the cartridge 14B. Thereupon, the movement of the cartridge 14B is restrained by the locking portion 45*b*, so that the cartridge is locked to the mounting section 20. At the same time, the unlocking and locking portions 45*a* and 45*b* are concealed under the cover 126 which defines the first and second engaging recesses 43*a* and 43*b*. Thus, the unlocking portion 45*a* cannot be pressed for release, so that the second toner cartridge 14B ceases to be removable the moment it is mounted.

In this state, the toner is supplied into the developing device 4 by pulling the film 14*c* on the bottom surface of the toner cartridge 14B in the direction of the arrow of FIG. 17.

Since the first and second toner cartridges are different in configuration, the subsequent toner cartridge cannot be mounted if they are mounted in a wrong order. Such trouble can, however, be avoided by packaging the first cartridge together with the developing device or the process unit including at least the developing device and separately providing the second toner cartridge as an option. Since some of those users who employ a low print ratio do not require use of the second toner cartridge, its optional provision makes the process unit very economical and lowers its initial cost.

According to the third embodiment arranged in this manner, as in the second embodiment, only two toner cartridges can be used at the most, without regard to the user's print ratio, even though the cartridge is replaced before the toner-empty state is detected. Accordingly, the toner supplied to the developing device 4 of the process unit 80 is restricted to an amount for two toner cartridges at the most. Thus, the waste toner amount can be minimized, so that a waste toner receiving section 17 can be designed having a minimum capacity, and therefore, the process unit 80 can be reduced in size.

According to the first to third embodiments described above, the process unit 80 is designed so that the photoconductive drum 1, main charger 2, developing device 4, cleaner 5, and de-electrifier 6 are integrally supported by means of the supporting member 7, as shown in FIG. 2. However, the present invention is not limited to this arrangement, and may be also applied to a developing device only or a process unit which includes at least a developing device. Preferably, the process unit should include a developing device and a waste toner receiving section.

FIGS. 20 to 28C show toner cartridges, a locking mechanism, etc. used in a process unit of a printer according to a fourth embodiment of the present invention. In the description of the fourth embodiment to follow, like reference numerals are used to designate the same portions as in the first embodiment, and a detailed description of those portions is omitted.

Figure 20:
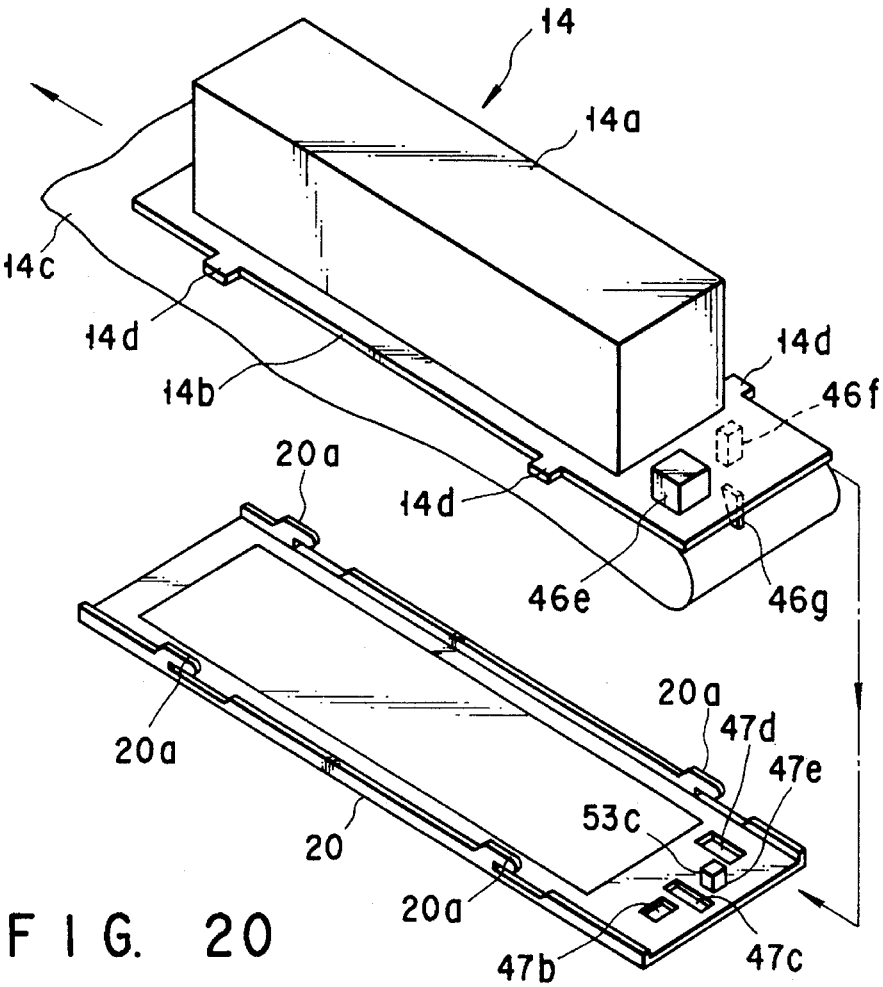

According to the fourth embodiment, as shown in FIG. 20, an engaging recess 46*e* and engaging projections 46*f* and 46*g* for locking a toner cartridge 14 are formed individually on the upper and lower surface, respectively, of a lengthwise end portion of a base plate 14*b* of the cartridge 14 on the side opposite to the stripping direction for a film 14*c*.

A mounting section 20 for the toner cartridge 14, which is formed on the upper surface of a developing device 4, is provided with windows 47*b*, 47*c* and 47*d*. The window 47*b* is situated so that it faces the engaging recess 46*e* when lugs 14*d* of the cartridge 14 are located so as to engage their corresponding retaining portions 20*a*. The windows 47*c* and 47*d* are elongate slots in which the engaging projections 46*g* and 46*f* are fitted and move, respectively, as the cartridge 14 slides. Further, the mounting section 20 is provided with a window 47*e* in which a projection 53*c* of a rotation assist member 53 (mentioned later) is inserted.

Figure 21A:
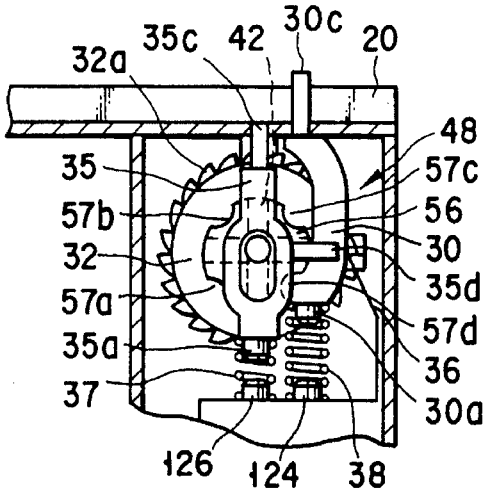
FIGS. 21A, 21B and 21C are a left-hand side view, a front view, and a right-hand side view, respectively, of a locking mechanism for locking the toner cartridge.
Figure 21B:
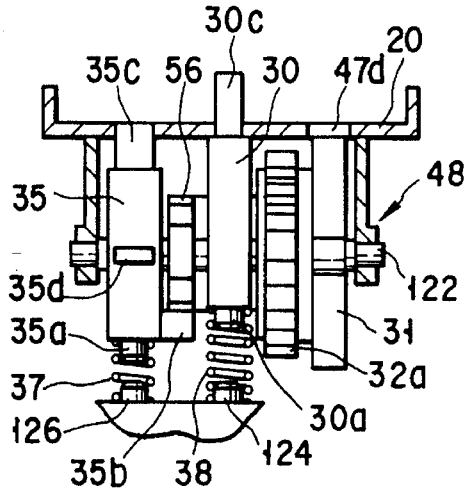
Figure 21C:
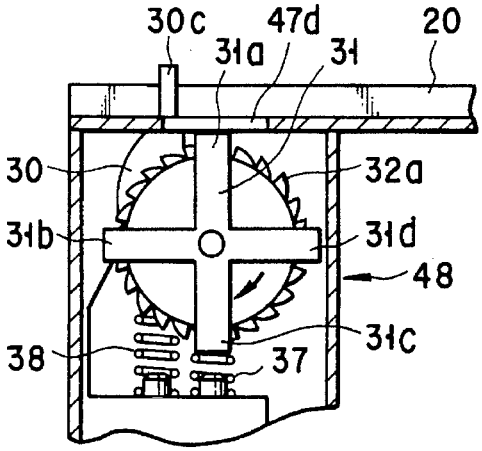
Figure 21D:
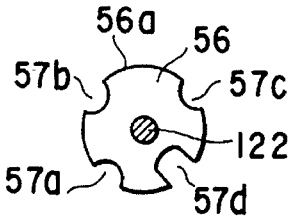
FIG. 21D is a front view of a cam of the locking mechanism.

FIGS. 21A, 21B and 21C show an arrangement of a locking mechanism 48 which is-mounted on the developing device 4 and serves to lock the toner cartridge 14. The mechanism 48 is constructed in the same manner as the locking mechanism 29 according to the second embodiment except for the arrangement of the cam and the locking member. Therefore, like reference numerals are used to designate the same portions as in the second embodiment, and a detailed description of those portions is omitted, that is, only different portions will be described below.

In the locking mechanism 48, a cam 56 fixed to a rotating shaft 122 has an annular cam face 56*a* coaxial with the shaft 122, and four recesses 57*a*, 57*b*, 57*c* and 57*d* are formed on the face 56*a*, at regular intervals in the circumferential direction. The recess 57*d* is deeper than any of the other recesses.

The locking member 35, which extends at right angles to the mounting section 20, includes an engaging projection 35*c* at its mounting-section-side end, a spring retainer 35*a* projecting on the other end side, and a columnar cam follower 35*b* protruding from the other end and in engagement with the cam face 56*a* of the cam 56. The distal end of the projection 35*c* is fitted in the window 47*e* of the mounting section 20. A compression spring 37 is interposed between the spring retainer 35*a* and another spring retainer 126 which is provided on the developing device 4 so as to face the retainer 35*a*. The locking member 35 is urged toward the mounting section 20 by the spring 37 so that the cam follower 35*b* is pressed against the cam face 56*a*. In the present embodiment, moreover, the locking member 35 has an engaging projection 35*d* protruding sideways from its middle portion.

The locking mechanism 48, constructed in this manner, operates in the same manner as the locking mechanism 29 according to the second embodiment except for the following points. In the locking mechanism 48, the four recesses 57*a* to 57*d* are formed on the cam face 56*a* of the cam 56. Every time each toner cartridge is mounted, therefore, the cam follower 35*b* of the locking member 35 engages one of the recesses, so that the member 35 moves to its locking position, thereby locking the cartridge to the mounting section 20.

According to the fourth embodiment, therefore, an unlocking mechanism is provided for each of an available number of toner cartridges.

Figure 22A:
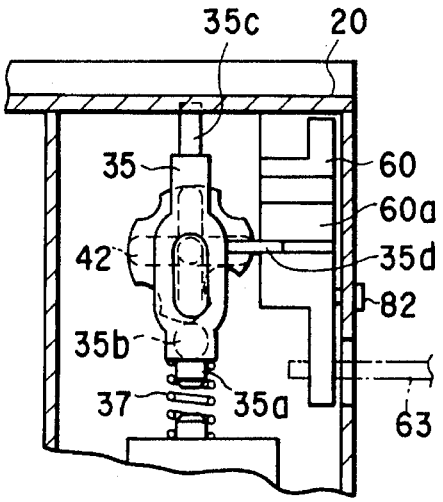
FIGS. 22A and 22B are a side view and a front view, respectively, showing part of the locking mechanism and an unlocking member.
Figure 22B:
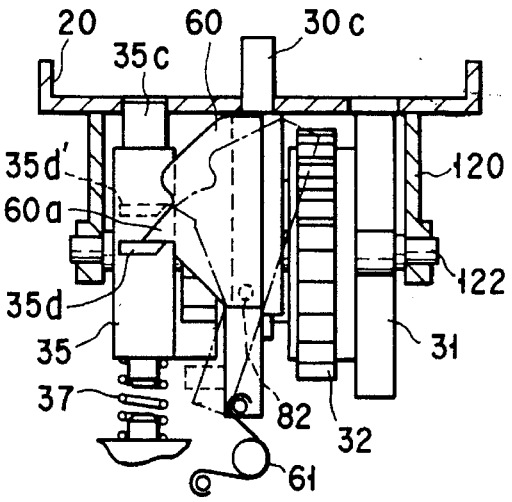
Figure 23:
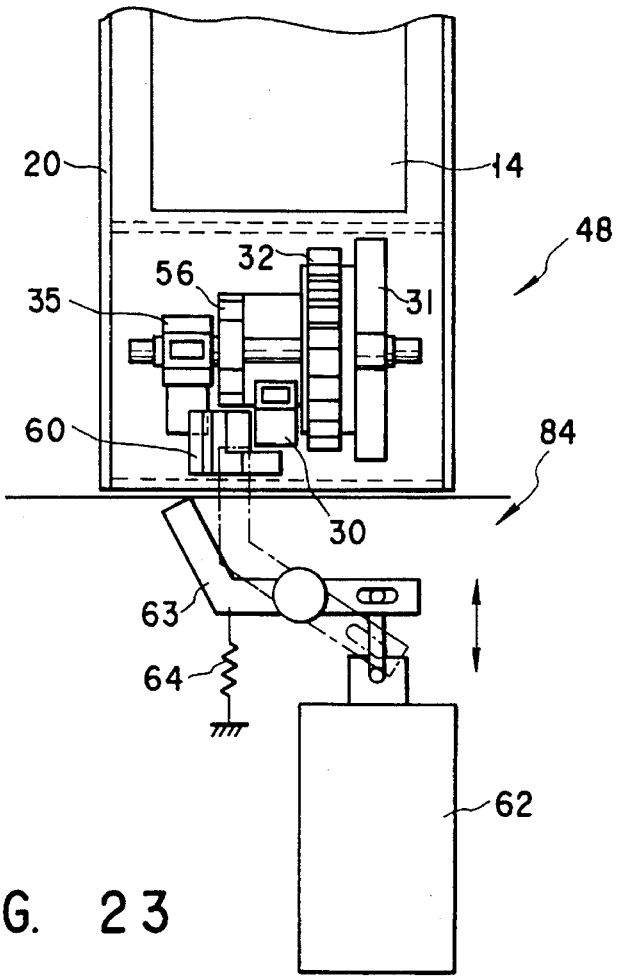

As shown in FIGS. 22A, 22B and 23, the unlocking mechanism includes an unlocking member 60 mounted on a supporting frame 120 by means of a pivot 82. The member 60 is rockable between an operating position indicated by full line in FIG. 22B and a nonoperating position indicated by dashed line. A torsion spring 61 is provided between one end of the unlocking member 60 and the frame 120. The member 60 is elastically held in the operating or nonoperating position by means of the urging force of the spring 61. The unlocking member 60 has a press portion 60*a* which can engage the engaging projection 35*d* of the locking member 35. When the unlocking member is rocked from the nonoperating position to the operating position with the locking member in the locking position, the press portion 60*a* depresses the projection 35*d*, thereby moving the locking member to its unlocking position. Thereupon, the toner cartridge 14 is unlocked.

The unlocking mechanism further includes an operating portion 84 for rocking the unlocking member 60 from the nonoperating position to the operating position. The portion 84 includes a solenoid 62 and a press arm 63 connected to the plunger of the solenoid. Normally, the arm 63 is held in its nonoperating position indicated by full line in FIG. 23 by a spring 64. When the solenoid 62 is energized, the press arm 63 is rocked from the nonoperating position to its operating position indicated by dashed line. While doing this, the arm 63 presses the lower end portion of the unlocking member 60, thereby causing the member 60 to rock from the nonoperating position to the operating position.

The following is a description of the operations of the locking mechanism 48 and the unlocking mechanism constructed in this manner. The same portions as in the second embodiment will be described only briefly.

Figure 24A:
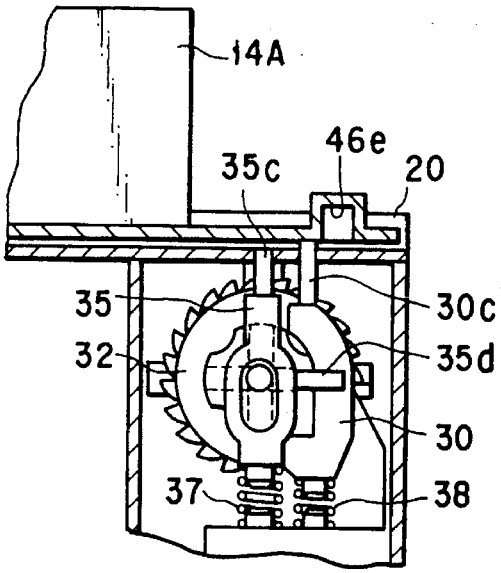
FIGS. 24A, 24B and 24C are a left-hand side view, a front view, and a right-hand side view, respectively, of the locking mechanism with a first toner cartridge placed on the mounting section.
Figure 24B:
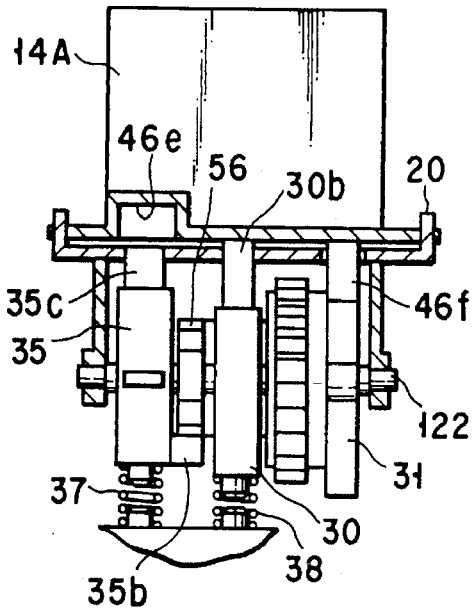
Figure 24C:
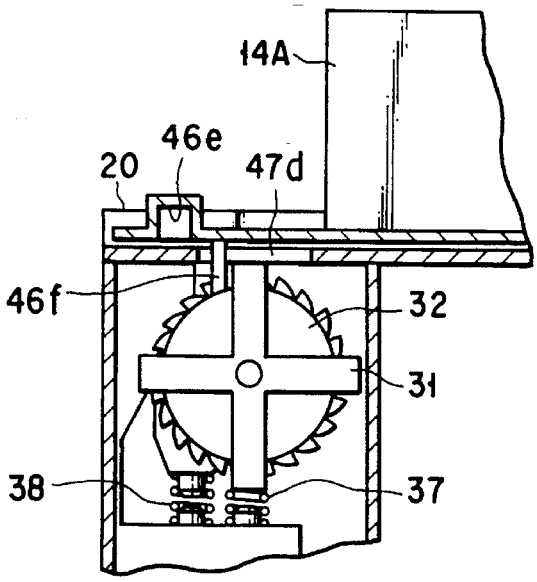

When a first toner cartridge 14A is mounted on the mounting section 20 of the developing device 4, as shown in FIGS. 24A, 24B and 24C, the engaging projection 30*c* of the rotation assist member 30, which projects through the window 47*e* of the section 20, is pushed in by the base plate 14*b* of the cartridge 14A. At the same time, the engaging projection 46*f* of the cartridge 14A is inserted in the window 47*d* of the mounting section 20, and faces one arm 31*a* of a runner 31.

Figure 25A:
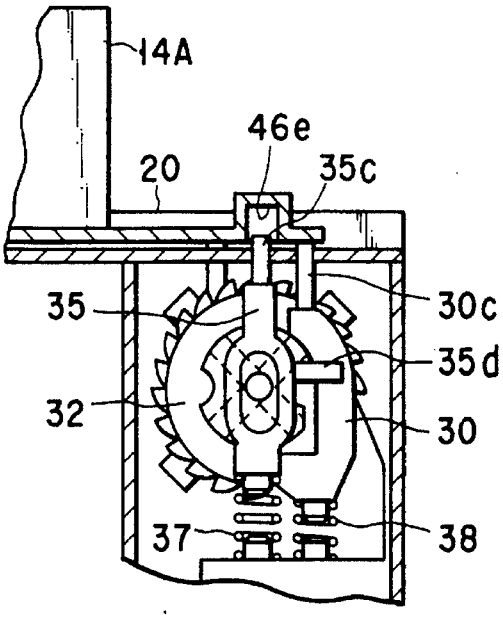
FIGS. 25A, 25B and 25C are a left-hand side view, a front view, and a right-hand side view, respectively, of the locking mechanism with the first toner cartridge mounted on the mounting section.
Figure 25B:
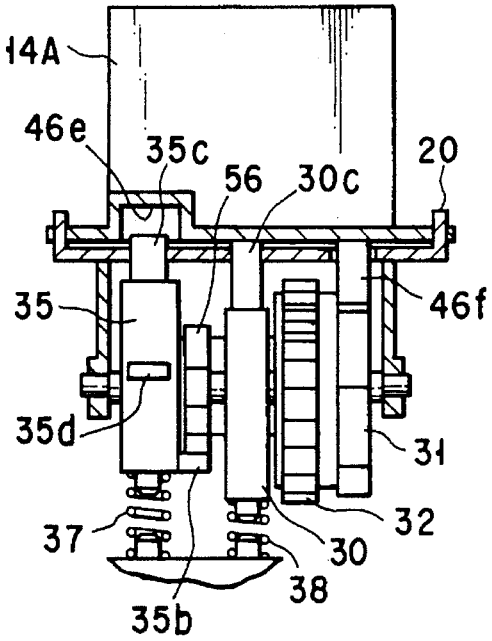
Figure 25C:
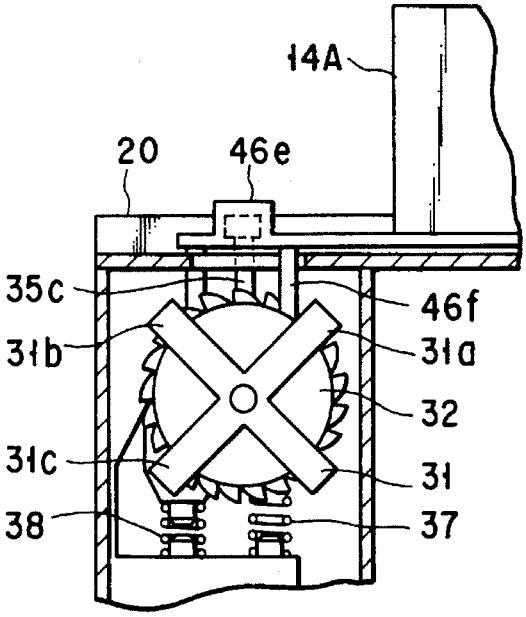

When the toner cartridge 14A is slid to the position where its lugs 14*d* are caught by their corresponding retaining portions 20*a* of the mounting section 20, its engaging projection 46*f* presses the arm 31*a* of the runner 31, as shown in FIGS. 25A, 25B and 25C, thereby rotating the impeller and the rotating shaft 122 for the predetermined angle θ. As the shaft 122 rotates in this manner, an angle adjusting member 42 and the cam 56 also rotate for the angle θ. In the meantime, the cam follower 35*b* of the locking member 35 moves on the arcuate cam face 56*a*. When the first recess 57*a* moves to the position where it faces the cam follower 35*b* as the cam 56 rotates, the cam follower, along with the locking member 35, rises to be fitted in the recess 57*a*. At the same time, the engaging projection 35*c* of the locking member 35 projects into the engaging recess 46*e* of the toner cartridge 14A through the window 47*d*. Thus, the cartridge 14A is locked to the mounting section 20.

Figure 26A:
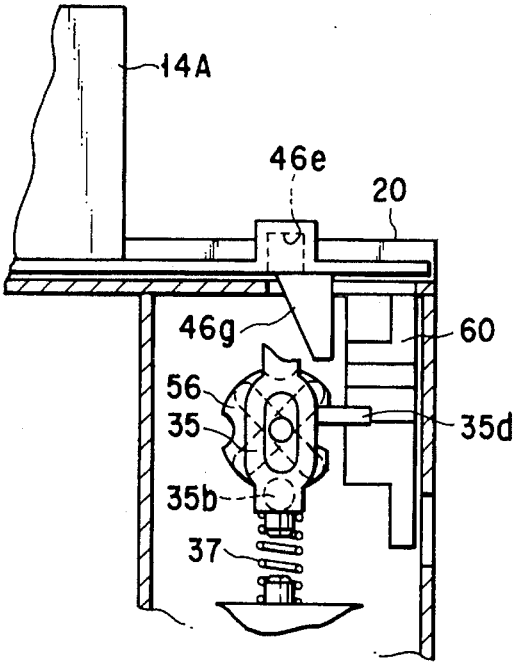
FIGS. 26A and 26B are a side view and a front view, respectively, showing the way the unlocking member is moved to its nonoperating position by an engaging projection of the toner cartridge.
Figure 26B:
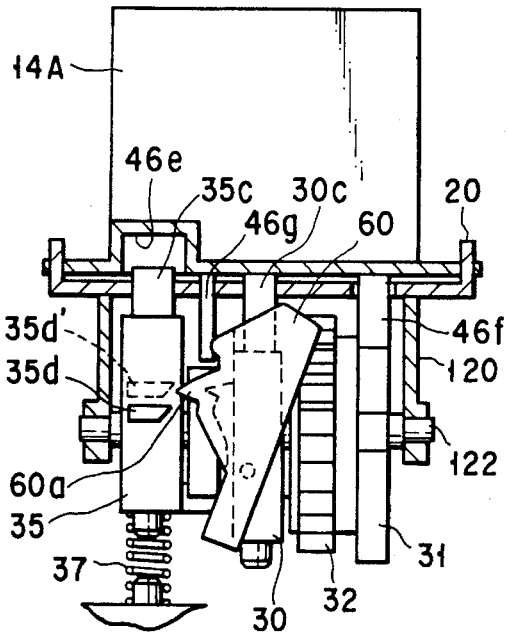

Before the toner cartridge 14A is mounted, the unlocking member 60 of the unlocking mechanism is normally situated in the nonoperating position indicated by dashed line in FIG. 22B. If the member 60 is situated in the operating position indicated by full line in FIG. 22B for any reason, however, the locking member 35 cannot move to the locking position, so that the cartridge 14A cannot be locked when it is mounted. To avoid this, the engaging projection 46*g* of the toner cartridge 14A is designed so as to press the unlocking member 60 and restore it to the nonoperating position as the cartridge slides, as shown in FIGS. 26A and 26B.

When a reduction of the amount of the toner in a toner storage section of the developing device 4 below the predetermined value, caused by the use of the printer, is detected by means of a toner-empty sensor 12 (FIG. 2), thereafter, the solenoid 62 of the unlocking mechanism is energized in response to a detection signal from the sensor 12. Thereupon, the press arm 63 is rocked from the nonoperating position to the operating position, thereby causing the unlocking member 60 to rock from the nonoperating position to the operating position. Accordingly, the locking member 35 is pressed down and moved to the unlocking position by the unlocking member 60 through the medium of the engaging projection 35*d*. Thus, the engaging projection 35*c* of the member 35 is disengaged from the engaging recess 46*e* of the toner cartridge 14A, so that the cartridge is unlocked and allowed to be replaced. At the same time, the cam follower 35*b* of the locking member 35 is disengaged from the recess 57*a* of the cam 56, so that the cam is allowed to rotate.

Since the toner cartridge can be replaced with a new one only when the toner-empty state is detected, as described above, it cannot be changed with the toner remaining therein, so that spilling of the toner or the like can be prevented.

Figure 27A:
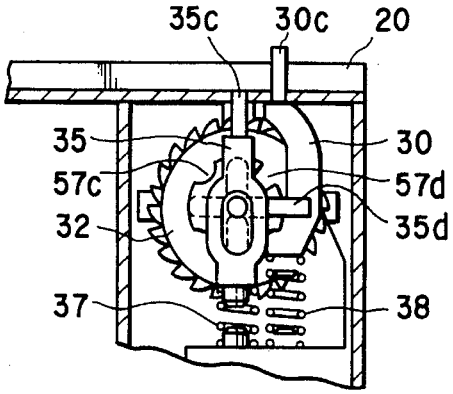
FIGS. 27A, 27B and 27C are a left-hand side view, a front view, and a right-hand side view, respectively, of the locking mechanism with the first toner cartridge off the mounting section.
Figure 27B:
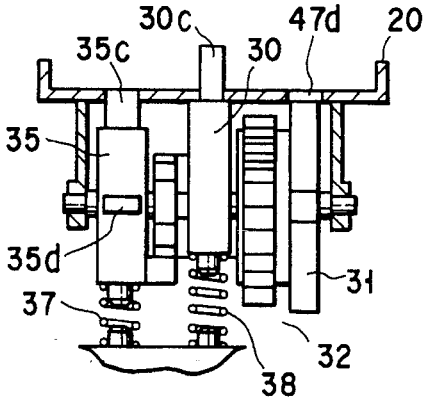
Figure 27C:
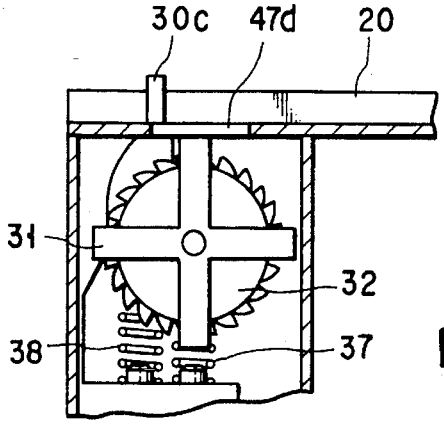

When the first toner cartridge 14A is removed from the mounting section 20, as shown in FIGS. 27A, 27B and 27C, each rotating member of the locking mechanism 48 is rotated for 90° from the angular position taken before the first cartridge is mounted. As the use of the printer is advanced, thereafter, the processes of operation shown in FIGS. 24A to 25C and 27A to 27C are repeated for the first three toner cartridges (maximum available toner cartridges but one), and the cartridges are replaced in succession. In the meantime, the each rotating member of the locking mechanism 48 rotates for 270° from its initial position.

Figure 28A:
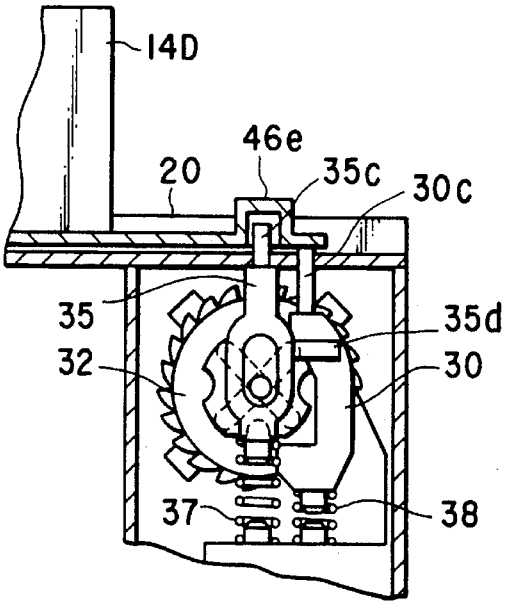
Figure 28B:
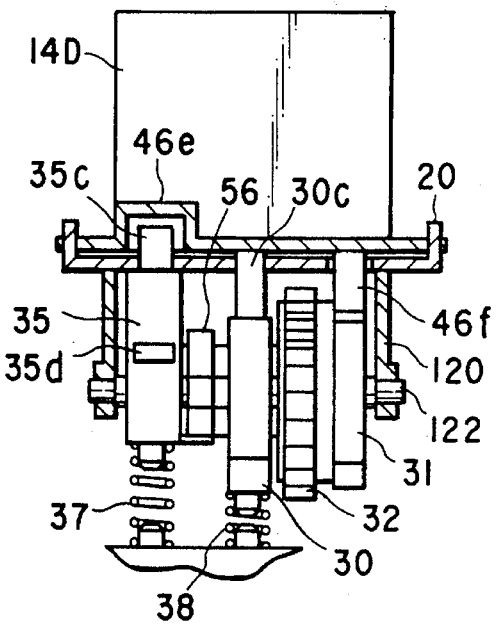
Figure 28C:
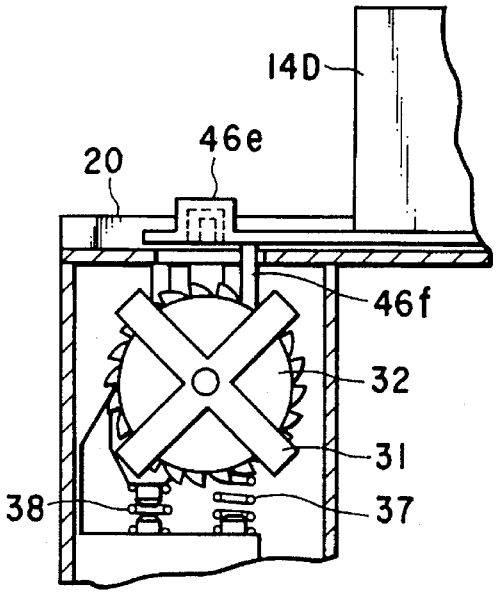

When a fourth toner cartridge 14D (last of the maximum available toner cartridges) is mounted on the mounting section 20 of the developing device 4, as in the case of the other toner cartridges, the locking member 35 moves to the locking position to lock the cartridge 14D, as shown in FIGS. 28A, 28B and 28C. In this case, however, the fourth recess 57*d* of the cam 56, in which the cam follower 35*b* of the member 35 is fitted, is deeper than the other recesses 57*a*, 57*b* and 57*c*. Therefore, the locking member 35 rises for a distance longer than when the other cartridges are mounted, to be held in a second locking position. Thereupon, the engaging projection 35*c* of the member 35 is inserted into the engaging recess 46*e* of the toner cartridge 14D through the window 47*b* of the mounting section 20. In this case, the engaging projection 35*d* of the member 35 is situated in a position (position 35*d*' indicated by broken line in FIG. 26B) nearer to the mounting section 20 than in the case of the other cartridges.

Even when the solenoid 62 of the unlocking mechanism is energized in response to the signal from the toner-empty sensor 12 so that the unlocking member 60 is rocked to the operating position, therefore, the press portion 60*a* of the member 60 never engages the engaging projection 35*d* of the locking member 35, since the projection 35*a* is situated in the elevated position 35*d*'. Accordingly, the engaging projection 35*c* of the locking member 35 cannot be removed from the engaging recess 46*e* of the toner cartridge 14D by depressing the member 35 by means of the unlocking member 60. When the fourth toner cartridge (the last of the maximum available toner cartridges) is mounted on the mounting section 20, therefore, it is fully locked and prevented from being replaced.

According to the fourth embodiment arranged in this manner, the available toner cartridges are restricted to four in number, and each cartridge cannot be removed before the toner-empty state is detected. Accordingly, the capacity of the toner storage section 8 of the developing device can be minimized. Further, the capacity of a waste toner receiving section 17 can be minimized by restricting the maximum available toner cartridge number, and the toner can be securely prevented from running out of the developing device during the replacement of the cartridge.

The following is a description of a life management method for the process unit 80 of the replaceable-cartridge type described above.

Figures 29, 30:
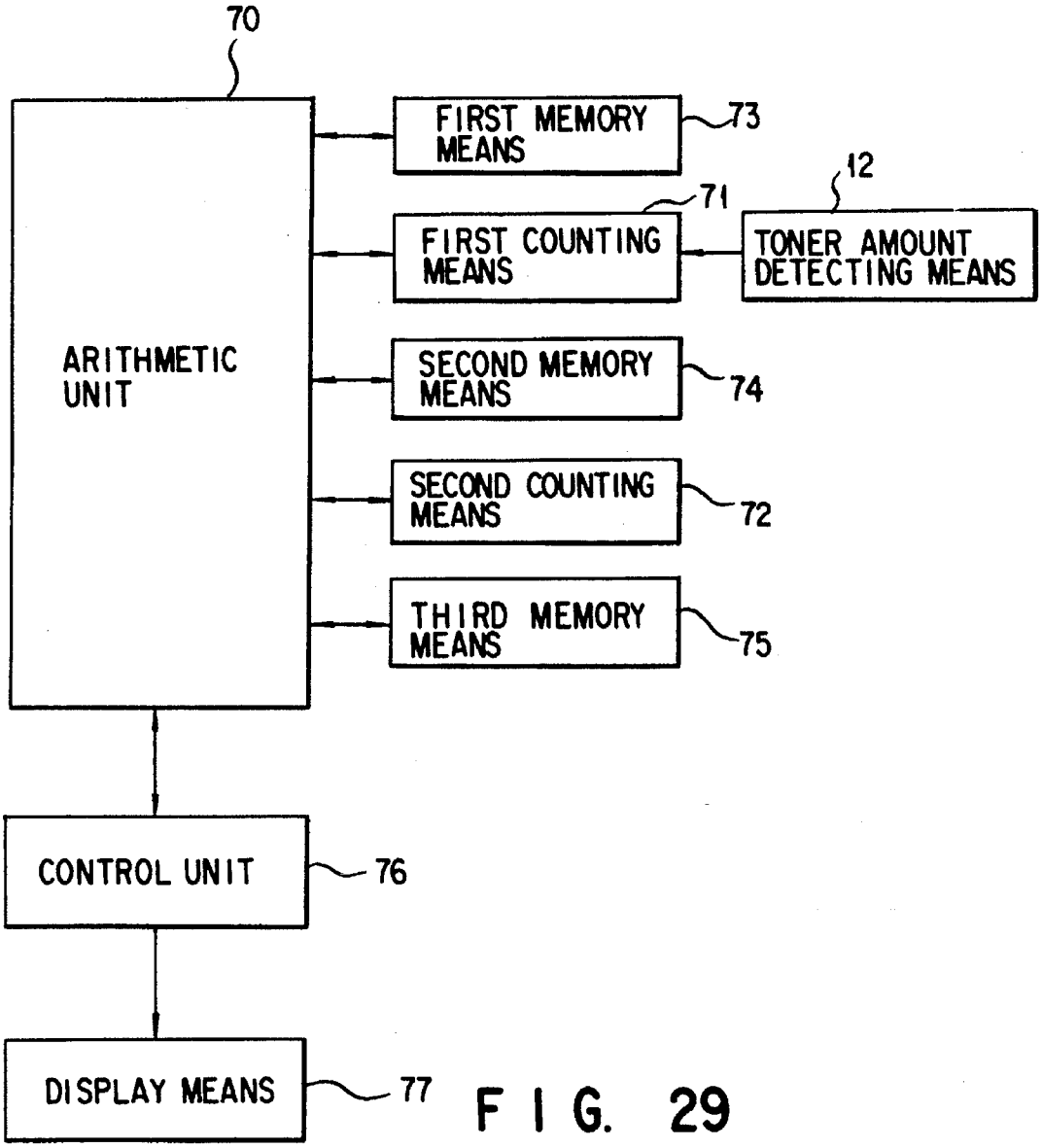
FIG. 29 is a block diagram schematically showing an arrangement of a life management system of the image forming apparatus shown in FIG. 1.
FIG. 30 is a diagram schematically showing an arrangement of a third memory of the life management system.

As shown in FIG. 29, a life management system comprises a first counter unit 71, which performs counting operation every time the reduction of the amount of the toner in the toner storage section 8 of the developing device 4 below the predetermined value is detected, and a second counter unit 72 for counting prints produced by the process unit 80. This system further comprises a first memory 73 for storing a count value of the first counter unit 71 through an arithmetic unit 70, a second memory 74 for storing a count value of the second counter unit 72 through the arithmetic unit 70, and a third memory 75 for storing a number of available prints (hereafter referred to available print number), which the process unit 80 can produce before the expiration of its lifetime, obtained by comparative computation by means of the arithmetic unit 70 on the basis of the values stored in the first and second memories. Nonvolatile memories are used as the first to third memories 73 to 75.

If a one-component developer is employed, various sensors, including a piezoelectric dust sensor, such as the one shown in FIG. 2, optical sensor of the light transmission or reflection type, driving torque sensor using a mechanical system, magnetic sensor, etc., may be used as the toner-empty sensor 12.

Further, the arithmetic unit 70 is connected with a control unit 76 for controlling the printer on the basis of the results of computation by the unit 70. The control unit is connected with a display unit 77 for displaying the time for replacement of expendables, serviceman calls, etc.

Figure 31:
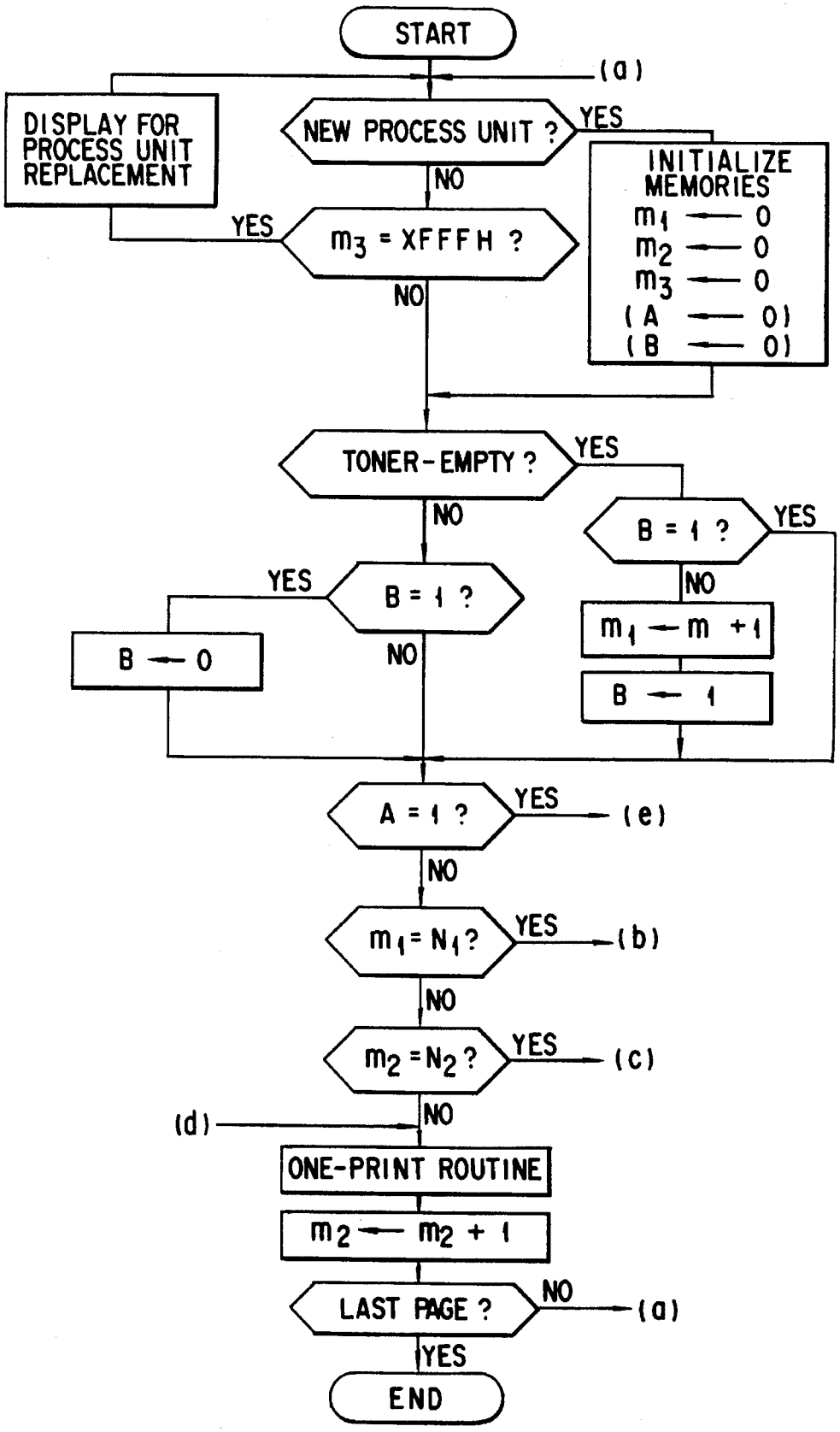
FIGS. 31, 32 and 33 are flow charts showing the operation of the life management system.
Figure 32:
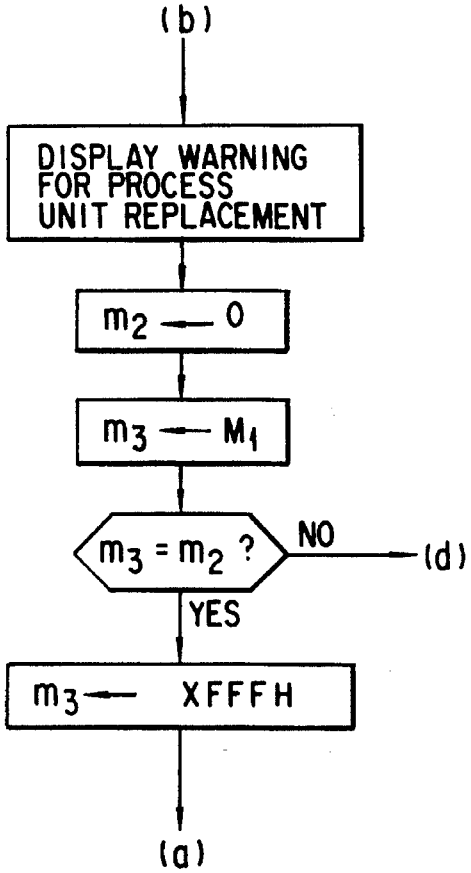
Figure 33:
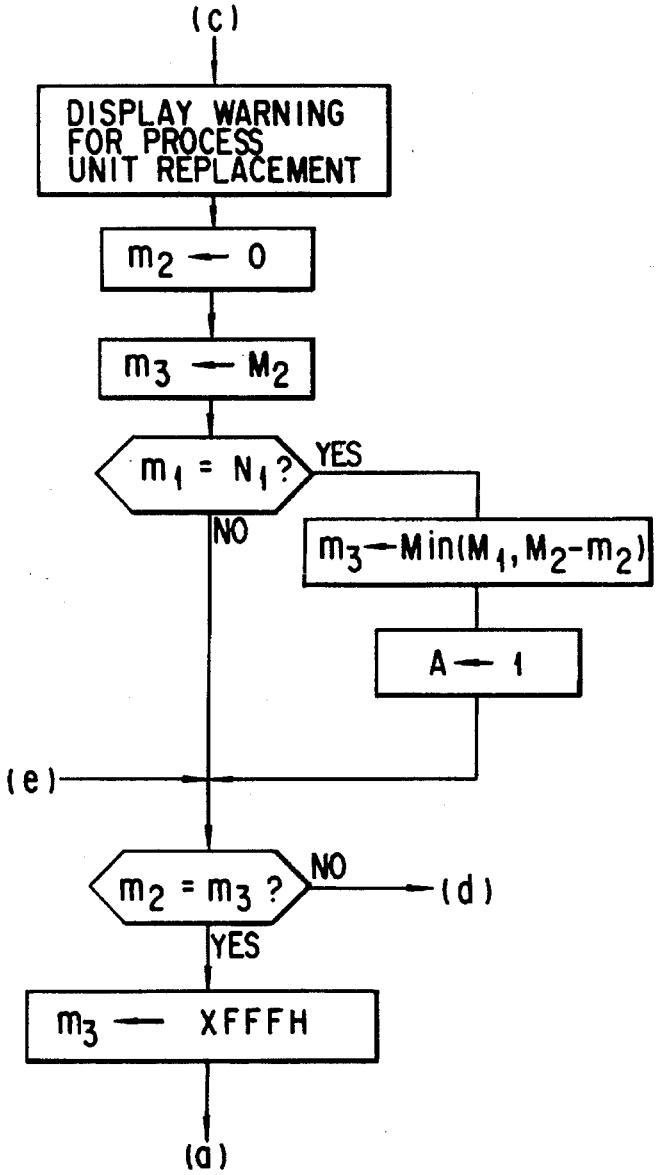

Referring now to the flow charts of FIGS. 31, 32 and 33, life management control will be described. These flow charts illustrate control processes executed with use of N2 and N1 as the values of the set lifetime of the process unit 80 (available print number) and the maximum available toner cartridge number, respectively.

When the process unit 80 is mounted in the housing of the printer, it is first checked for newness. Conventionally known methods for this newness check include, for example, a totally electrical method in which the process unit 80 is checked for continuity by supplying a current to the unit such that a fuse contained therein blows, a method in which the unit 80 is checked for newness by using a gear which has a threaded shaft such that the gear shifts in the axial direction as the unit 80 is driven, etc.

If it is concluded that the process unit 80 is new, the memories are initialized, that is, the first, second, and third memories 73, 74 and 75 (hereinafter referred to as memories m1, m2 and m3), which are formed of semiconductor memories backed up by batteries or the like, for example, are zero-reset, and flags A and B are cleared.

When the toner-empty sensor 12 detects the toner-empty state, an instruction for toner cartridge replacement is displayed on the display unit 77 which is provided on a control panel on the printer body, for example. Further, 1 is added to the value in the memory m1, and "1" is set in the flag B. By thus setting "1" in the flag B, the content of the memory ml can be prevented from incrementing by 1 when the toner cartridge is not replaced after the toner-empty state is detected. The content of the memory m2 increments by 1 with every print produced by the process unit 80.

Here the control routine divides into two flows, depending on the circumstances.

One flow is followed when the maximum available toner cartridge number N1 becomes equal to the value in the memory m1 after several cycles of toner cartridge replacement. In this case, a warning for process unit replacement is displayed on the display unit 77, and the memory m2 stored with the quantity of prints for the working process unit 80 is zero-reset, as shown in FIG. 32.

Then, the memory m3 is loaded with the available print number M1, and printing control is continued by means of the control unit 76 until the values in the memories m2 and m3 become equal to each other as the printing operation is performed. When m2=m3 is obtained, the memory m3 is loaded with given data (× FFFH), the instruction for process unit replacement is displayed on the display unit 77, and the printing operation by means of the control unit 76 is prohibited until the process unit 80 is replaced.

The other flow is followed when the value in the memory m2 stored with the total print quantity for the working process unit 80 becomes equal to the value of the set life N2 for the process unit. In this case, the warning for process unit replacement is displayed on the display unit 77, and the memory m2 stored with the quantity of prints for the working process unit 80 is zero-reset, as shown in FIG. 33.

Then, the memory m3 is loaded with an available print number M2, and the printing operation is continued under the control of the control unit 76 until the values in the memories m2 and m3 become equal to each other. When m2=m3 is obtained, the memory m3 is loaded with given data (× FFFH), the instruction for process unit replacement is displayed on the display unit 77, and the printing operation by the control unit 76 is prohibited until the process unit is replaced.

If the value in the memory m1 becomes equal to the maximum available toner cartridge number N1 before m2=m3 is obtained, however, life management is accomplished by reloading the memory m3 with the available print number M1 or a value obtained by subtracting the value in the memory m2, stored with the quantity of prints produced after the display of the warning for process unit replacement, from the available number M2, that is, the current number of available prints (M2–[m2]), whichever is smaller, as an available print number.

In reloading the memory m3, the flag A is set, whereupon the memory m3 cannot be reloaded with the available print number until the process unit 80 is replaced so that the memory is initialized.

Since the flags A and B is expected to be nonvolatile from the viewpoint of life management, they are formed of the two highest-order bits, i.e., d15 and d14, respectively, of the memory m3 which is composed of 16 bits d0 to d15, as shown in FIG. 30.

In the case where the toner-empty sensor is used as the toner amount detecting means, the value of the available print number M1 takes a small value which varies depending on the type of the toner-empty sensor. If the toner amount is adjusted to a value just large enough for characters not to become blurred when printed with a print ratio of 5%, for example, the number M1 may be 50 or thereabout. If the toner amount detecting means is not an empty sensor but one which detects nothing but the toner amount, however, the available print number M1 takes a larger value.

Since printing cycles exceeding the set lifetime are assigned to the process unit, moreover, the available print number M2 takes a value which is deeply associated with the respective mechanical lives of individual process means.

Thus, delicate circumstances for the use of the toner can be provided by employing the two control routines or flows for the life management, the one based on the toner amount detection (memory m1) and the other based on the number of prints for the process unit (memory m2). Moreover, the life management control can be improved by reloading the memory m3 with an available print number based on the values in the memories m1 and m2, in the second control routine.

The life management control method described above can be further improved by being combined with each of the foregoing embodiments.

More specifically, in most of control methods including one according to a fifth embodiment, the life management control can be monitored only in accordance with the number of prints if the toner cartridge is replaced before the reduction of the toner amount below the predetermined value is detected by the toner amount detecting means (toner-empty sensor). Accordingly, if the user's print ratio is extremely high, the capacity of the waste toner receiving section in the process unit must be made very large.

To avoid this, it is advisable to use the process unit according to any of the first, second, and fourth embodiments, preferably the one according to the fourth embodiment.

According to the present invention, as described in detail herein, the toner cartridges are locked by means of the locking member when they are mounted, and are allowed to be replaced only when the reduction of the amount of the toner in the toner storage section below the predetermined value is detected. Thus, the toner can be prevented from spilling and soiling the surroundings. All the toner cartridges have the same configuration, and the locking member shifts its position every time each cartridge is mounted. When the last one of a predetermined number of toner cartridges, two or more, is mounted, the locking member serves to prevent the toner cartridges from being disengaged from the developing device or a unit including at least the developing device. Thus, the waste toner receiving section, and therefore, the whole apparatus, can be reduced in size.

According to the present invention, moreover, the first and second toner cartridges are made partially different in configuration, and are disabled from being disengaged from the developing device or the unit including at least the developing device when the second cartridge is mounted. Thus, the user can be prevented from replacing the toner cartridges by mistake, and the life management of the process unit can be executed securely. Furthermore, there may provided a very compact image forming apparatus with improved practicality, in which the capacity of the toner storage section and toner receiving section can be minimized, and the toner can be used effectively.

What is claimed is:

1. A developing device for developing an electrostatic latent image formed on an image carrier, by means of toner, the developing device comprising:

toner storage means for storing toner;

means for supplying the toner in the toner storage means to the image carrier so as to develop the electrostatic latent image;

a replaceable toner cartridge storing toner therein and mounted on the toner storage means, for supplying the toner to the toner storage means;

means for locking the toner cartridge on the toner storage means lest the toner cartridge be replaced by another;

means for detecting the amount of the toner in the toner storage means; and means for unlocking the toner cartridge locked by the locking means only when the detecting means detects that the amount of the toner in the toner storage means decreases below a predetermined value.

2. A device according to claim 1, wherein the toner storage means has a toner storage capacity which is smaller than a toner storage capacity of the toner cartridge.

3. An image forming apparatus comprising:

a process unit for producing prints, the process unit having an image carrier, and a developing device for developing an electrostatic latent image formed on the image carrier, by means of toner, the developing device including:

toner storage means for storing toner, means for supplying the toner in the toner storage means to the image carrier so as to develop the electrostatic latent image, a replaceable toner cartridge storing toner therein and mounted on the toner storage means, for supplying the toner to the toner storage means, means for locking the toner cartridge on the toner storage means lest the toner cartridge be replaced by another, means for detecting the amount of the toner in the toner storage means, and means for unlocking the toner cartridge locked by the locking means only when the detecting means detects that the amount of the toner in the toner storage means decreases below a predetermined value, the process unit having a predetermined available lifetime print number which the process unit is able to produce before the expiration of its lifetime, and a predetermined available toner cartridge number which the process unit is able to use;

first counting means for counting cycles of detection of a reduction of the amount of the toner below the predetermined value by the detecting means, second counting means for counting prints produced by the process unit, first memory means for storing count value in the first counting means, second memory means for storing count value in the second counting means, third memory means for storing an available print number for the process unit, and control means for resetting the count value stored in the second memory means, storing a desired available print number in the third memory means, and controlling the number of prints for the process unit after the reset of the second memory means in accordance with the available print number stored in the third memory means, when the count value in the second memory means is equal to the lifetime print number of the process unit or when the count value in the first memory means is equal to the available toner cartridge number for the process unit.

4. An apparatus according to claim 3, which further comprises warning means for issuing a warning for the replacement of the process unit, and said control means has means for actuating the warning means when the count value in the second memory means is equal to the lifetime print number of the process unit or when the count value in the first memory means is equal to the available toner cartridge number for the process unit.

5. An image forming apparatus comprising:

a developing device for developing an electrostatic latent image formed on an image carrier using toner;

the developing device including toner storage means for storing toner, means for supplying the toner in the toner storage means to the image carrier so as to develop the electrostatic latent image, a replaceable toner cartridge storing toner therein and mounted on the toner storage means, for supplying the toner to the toner storage means, and locking means for locking the toner cartridge on the toner storage means when toner cartridge replacement has been executed a predetermined number of times, to prevent the toner cartridge from being detached from the toner storage means and being replaced by another.

6. An apparatus according to claim 5, wherein said locking means includes a rotating member rotatable for a fixed angle in one direction every time the toner cartridge is replaced, and a locking member in engagement with the rotating member, for locking the toner cartridge lest the cartridge be replaceable when the rotating member is rotated a predetermined angle.

7. An apparatus according to claim 6, wherein said locking means comprises means for supporting the locking member to be movable between a locking position, in which the locking member engages and locks the toner cartridge, and an unlocking position, in which the locking member is disengaged from the toner cartridge; and means for urging the locking member toward the locking position; and said rotating member includes a cam for normally holding the locking member in the unlocking position and for allowing the locking member to move to the locking position when rotated by the predetermined angle.

8. An apparatus according to claim 5, wherein said locking means includes a locking portion for engaging and locking the toner cartridge when the cartridge is mounted, and an unlocking portion arranged for external operation, for unlocking the locking portion, and the last one of said predetermined number of toner cartridges has a concealing portion for covering the unlocking portion to prevent the external operation thereof when the last toner cartridge is mounted.

9. An apparatus according to claim 5, wherein the toner storage means has a toner storage capacity which is smaller than a toner storage capacity of the toner cartridge.

10. An apparatus according to claim 5, which further comprises a process unit, for producing prints, the process unit including the image carrier, the developing device, and a lifetime during which two toner cartridges are allowed to be used, and wherein the locking means has means for locking the second toner cartridge mounted on the toner storage means.

11. An image forming apparatus comprising:

an image carrier; and a developing device for developing an electrostatic latent image formed on the image carrier, by means of toner;

the developing device including:

toner storage means for storing toner, means for supplying the toner in the toner storage means to the image carrier so as to develop the electrostatic latent image, a replaceable toner cartridge storing toner therein and mounted on the toner storage means, for supplying the toner to the toner storage means, means for locking the toner cartridge on the toner storage means lest the toner cartridge be replaced by another, means for detecting the amount of the toner in the toner storage means, means for unlocking the toner cartridge locked by the locking means only when the detecting means detects that the amount of the toner in the toner storage means decreases below a predetermined value, and restraining means for preventing the unlocking means from unlocking the toner cartridge when the last one of a predetermined number of toner cartridges is mounted.

12. An apparatus according to claim 11, wherein said locking means includes a rotating member for rotating for a fixed angle in one direction every time the toner cartridge is replaced, a locking member movable between a locking position, in which the locking member engages and locks the toner cartridge, and an unlocking position, in which the locking member is disengaged from the toner cartridge, and urging means for urging the locking member toward the locking position, and said rotating member includes a cam for holding the locking member in the unlocking position when the toner cartridge is removed and to allow the locking member to move to the locking position every time the rotating member rotates for the fixed angle.

13. An apparatus according to claim 12, wherein said unlocking means includes an unlocking member movable between an operating position, in which the unlocking member engages the locking member, and a nonoperating position, in which the unlocking member is disengaged from the locking member, so that the locking member is moved to the unlocking position as the unlocking member moves from the nonoperating position to the operating position, and an actuator for moving the locking member from the nonoperating position to the operating position in response to the detection by the detecting means.

14. An apparatus according to claim 13, wherein said locking member includes a cam follower, and said cam includes a cam face engaging the cam follower to hold the locking member in the unlocking position, and a plurality of recesses formed in the cam face, for engaging the cam follow to allow the locking member to move to the locking position, every time the cam rotates for the fixed angle, that one of the recesses which faces the cam follower when the last one of the predetermined number of toner cartridges is mounted being formed deeper than any other recesses so that the locking member is guided to a second locking position where the locking member engages and locks the toner cartridge and is prevented from engaging the unlocking member.

15. An image forming apparatus comprising:

a housing;

a process unit removably mounted in the housing, for producing prints, the process unit including an image carrier, and a developing device for developing an electrostatic latent image formed on the image carrier by means of toner, the developing device having toner storage means for storing toner, means for supplying the toner in the toner storage means to the image carrier;

a replaceable toner cartridge mounted on the developing device, for supplying toner to the toner storage means, the process unit having a predetermined available lifetime print number which the process unit is able to produce before the expiration of its lifetime, and a predetermined available toner cartridge number which the process unit is able to use;

detecting means for detecting a reduction of the amount of the toner in the toner storage section below a predetermined value;

first counting means for counting cycles of detection by the detecting means;

second counting means for counting prints produced by the process unit;

first memory means for storing count value in the first counting means;

second memory means for storing count value in the second counting means;

third memory means for storing an available print in number for the process unit; and control means for resetting the count value stored in the second memory means, storing a desired available print number in the third memory means, and controlling the number of prints for the process unit after the reset of the second memory means in accordance with the available print number stored in the third memory means, when the count value in the second memory means is equal to the lifetime print number of the process unit or when the count value in the first memory means is equal to the available toner cartridge number for the process unit.

16. An apparatus according to claim 15, which further comprises warning means for issuing a warning for the replacement of the process unit, and said control means has means for actuating the warning means when the count value in the second memory means is equal to the lifetime print number of the process unit or when the count value in the first memory means is equal to the available toner cartridge number for the process unit.

17. An apparatus according to claim 15, wherein said control means includes means for comparing the count value in the second counting means and the available print number stored in the third memory means after the reset of the second memory means, and means for disabling the operation of the process unit when the available print number stored in the third memory means is reached by the count value in the second counting means.

18. An apparatus according to claim 15, wherein said control means includes means for storing a first available print number in the third memory means when the count value stored in the second memory means is equal to the lifetime print quantity for the process unit, and for storing a second available print number different from the first available print number in the third memory means when the count value stored in the first memory means is equal to the available toner cartridge number for the process unit.

19. An apparatus according to claim 18, wherein said control means includes means for subtracting a count value newly stored in the second memory means after the reset from the first available print number so as to obtain a third available print number, and means for reloading the third memory means with the second available print number or the third available print number, whichever is smaller, when the first available print number is stored in the third memory means and when the count value in the first memory means and the available toner cartridge number for the process unit become equal to each other before the first available print number in the third memory means is reached by the print number after the reset.

20. An image forming apparatus comprising:

a developing device for developing an electrostatic latent image formed on an image carrier using toner;

the developing device including toner storage means for storing toner, means for supplying the toner in the toner storage means to the image carrier so as to develop the electrostatic latent image, a replaceable toner cartridge storing toner therein and mounted on the toner storage means, for supplying the toner to the toner storage means, and locking means for locking the toner cartridge on the toner storage means when toner cartridge replacement has been executed a predetermined number of times, to prevent the toner cartridge from being replaced by another, the locking means including a rotating member rotatable by a fixed angle in one direction every time the toner cartridge is replaced, a locking member in engagement with the rotating member, for locking the toner cartridge to prevent the toner cartridge from being replaced when the rotating member is rotated by a predetermined angle, means for supporting the locking member to be movable between a locking position, in which the locking member engages and locks the toner cartridge, and an unlocking position, in which the locking member is disengaged from the toner cartridge, and means for urging the locking member toward the locking position, the rotating member having a cam for normally holding the locking member in the unlocking position and for allowing the locking member to move to the locking position when rotated by the predetermined angle.

21. An image forming apparatus comprising:

a developing device for developing an electrostatic latent image formed on an image carrier using toner;

the developing device including toner storage means for storing toner, means for supplying the toner in the toner storage means to the image carrier so as to develop the electrostatic latent image, a replaceable toner cartridge storing toner therein and mounted on the toner storage means, for supplying the toner to the toner storage means, and locking means for locking the toner cartridge on the toner storage means when toner cartridge replacement has been executed a predetermined number of times, to prevent the toner cartridge from being replaced by another, the locking means including a locking portion for engaging and locking the toner cartridge when the toner cartridge is mounted, and an unlocking portion arranged for external operation, for unlocking the locking portion, the last one of a predetermined number of toner cartridges having a concealing portion for covering the unlocking portion to prevent external operation thereof when the last toner cartridge is mounted.

* * * * *